US009222326B2

(12) United States Patent
Whitby et al.

(10) Patent No.: US 9,222,326 B2
(45) Date of Patent: Dec. 29, 2015

(54) SUBSEA PRESSURE DELIVERY SYSTEM

(75) Inventors: Melvyn F. Whitby, Houston, TX (US); Gerrit Kroesen, Dickinson, TX (US); Roger Boisjolie, Houston, TX (US); Donald S. Coonrod, Katy, TX (US); Edmund A. Fisher, Houston, TX (US); Barbara J. Fisher, legal representative, Houston, TX (US)

(73) Assignee: Cameron International Corporation, Houston, TX (US)

( * ) Notice: Subject to any disclaimer, the term of this patent is extended or adjusted under 35 U.S.C. 154(b) by 845 days.

(21) Appl. No.: 12/935,395

(22) PCT Filed: Apr. 24, 2009

(86) PCT No.: PCT/US2009/041706

§ 371 (c)(1),
(2), (4) Date: Jun. 25, 2012

(87) PCT Pub. No.: WO2009/132300

PCT Pub. Date: Oct. 29, 2009

(65) Prior Publication Data

US 2012/0279720 A1 Nov. 8, 2012

Related U.S. Application Data

(60) Provisional application No. 61/047,624, filed on Apr. 24, 2008.

(51) Int. Cl.

| | |
|---|---|
| ***E21B 7/12*** | (2006.01) |
| ***E21B 33/035*** | (2006.01) |
| ***F15B 3/00*** | (2006.01) |
| ***F15B 21/00*** | (2006.01) |
| ***E21B 41/00*** | (2006.01) |

(52) U.S. Cl.
CPC ..... *E21B 33/0355* (2013.01); *E21B 41/0085* (2013.01); *F15B 3/00* (2013.01); *F15B 21/006* (2013.01)

(58) Field of Classification Search
CPC ..... E21B 33/0355; E21B 33/064
USPC ..... 166/363, 368; 251/1.1–1.3
See application file for complete search history.

(56) References Cited

U.S. PATENT DOCUMENTS 3,993,100 A 11/1976 Pollard et al.
4,777,800 A 10/1988 Hay, II (Continued)

FOREIGN PATENT DOCUMENTS

WO 2006068873 A1 6/2006

OTHER PUBLICATIONS

PCT/US2009/041706 International Search Report and Written Opinion, Nov. 25, 2009 (11 p.).

*Primary Examiner* — Matthew Buck
*Assistant Examiner* — Aaron Lembo
(74) *Attorney, Agent, or Firm* — Chamberlain Hrdlicka

(57) ABSTRACT

A subsea system including a frame including an intensifier, the intensifier providing structural support to the frame and capable of providing pressurized delivery fluid. The intensifier includes an intensifier chamber and a delivery fluid chamber separated by a piston, the intensifier chamber capable of receiving ambient pressure to provide a pressure on the delivery fluid through the piston. Also, a regulation system regulates the amount of ambient pressure communicated to the intensifier chamber to maintain the delivery fluid pressure substantially constant as the delivery fluid is depleted.

22 Claims, 42 Drawing Sheets

(56) References Cited

U.S. PATENT DOCUMENTS 5,429,036 A 7/1995 Latos
5,676,209 A * 10/1997 Reynolds ..... 166/345
6,998,724 B2 * 2/2006 Johansen et al. ..... 290/1 R
7,108,006 B2 9/2006 Armstrong
8,657,011 B2 * 2/2014 Vyas et al. ..... 166/335

* cited by examiner

| | Min Operating Depth (typical) ft. | Max Operating Depth (typical) ft. |
|---|---|---|
| Accumulator | 0 | 6000 |
| Intensifier w/o Recharge Pump | 6000 (min hydrostatic operation) | 9000 (min hydrostatic recharge) |
| Intensifier w/ Recharge Pump | 6000 (min hydrostatic operation) | 15000 |

FIG.2

SUBSEA PRESSURE DELIVERY SYSTEM

CROSS-REFERENCE TO RELATED APPLICATIONS

This application is a 35 U.S.C. §371 national stage application of PCT/US2009/041706 filed Apr. 24, 2009, which claims the benefit of U.S. Provisional Patent Application No. 61/047,624 filed Apr. 24, 2008, both of which are incorporated herein by reference in their entireties for all purposes.

BACKGROUND

Deepwater accumulators provide a supply of pressurized working fluid for the control and operation of subsea equipment, such as through hydraulic actuators and motors. Typical subsea equipment may include, but is not limited to, blowout preventers (BOPs) that shut off the well bore to secure an oil or gas well from accidental discharges to the environment, gate valves for the control of flow of oil or gas to the surface or to other subsea locations, or hydraulically actuated connectors and similar devices. Accumulator fluid power may be used to operate underwater process valves and connectors, as well as supply of non-continuous process chemicals into a process stream at the seafloor. Applications may also include management of fluid power and electrical power on subsea drilling BOP stacks, subsea production Christmas trees, workover and control systems (WOCS), and subsea chemical injection systems.

Accumulators are typically divided vessels with a gas section and a hydraulic fluid section that operate on a common principle. The principle is to precharge the gas section with pressurized gas to a pressure at or slightly below the anticipated minimum pressure required to operate the subsea equipment. Fluid can be added to the accumulator in the separate hydraulic fluid section, increasing the pressure of the pressurized gas and the hydraulic fluid. The hydraulic fluid introduced into the accumulator is therefore stored at a pressure at least as high as the precharge pressure and is available for doing hydraulic work.

Accumulators generally come in three styles—the bladder type having a balloon type bladder to separate the gas from the fluid, the piston type having a piston sliding up and down a seal bore to separate the fluid from the gas, and the float type with a float providing a partial separation of the fluid from the gas and for closing a valve when the float approaches the bottom to prevent the escape of the charging gas. A fourth type of accumulator is pressure compensated for depth and adds the nitrogen precharge pressure plus the ambient seawater pressure to the working fluid.

The precharge gas can be said to act as a spring that is compressed when the gas section is at its lowest volume/greatest pressure and released when the gas section is at its greatest volume/lowest pressure. Accumulators are typically precharged in the absence of hydrostatic pressure and the precharge pressure is limited by the pressure containment and structural design limits of the accumulator vessel under surface ambient conditions. Yet, as accumulators are used in deeper water, the efficiency of conventional accumulators decreases as application of hydrostatic pressure causes the gas to compress, leaving a progressively smaller volume of gas to charge the hydraulic fluid. The gas section must consequently be designed such that the gas still provides enough power to operate the subsea equipment under hydrostatic pressure even as the hydraulic fluid approaches discharge and the gas section is at its greatest volume/lowest pressure.

For example, accumulators at the surface typically provide 3000 psi working fluid maximum pressure. In 1000 feet of seawater the ambient pressure is approximately 465 psi. For an accumulator to provide a 3000 psi differential at 1000 ft. depth, it must actually be precharged to 3000 psi plus 465 psi, or 3465 psi.

At slightly over 4000 ft. water depth, the ambient pressure is almost 2000 psi, so the precharge would be required to be 3000 psi plus 2000 psi, or 5000 psi. This would mean that the precharge would equal the working pressure of the accumulator and any fluid introduced for storage may cause the pressure to exceed the working pressure and accumulator failure.

At progressively greater hydrostatic operating pressures, the accumulator thus has greater pressure containment requirements at non-operational (no ambient hydrostatic pressure) conditions.

The accumulator design must also take into account human error contingencies. For example, removal of the external ambient hydrostatic pressure without evacuating the fluid section of the accumulator to reestablish the original gas section precharge pressure may result in failure due to gas section pressures exceeding the original precharge pressures.

Accumulators may be included, for example, as part of a subsea BOP stack assembly assembled onto a subsea wellhead. The BOP assembly may include a frame, BOPs, and accumulators to provide back up hydraulic fluid pressure for actuating the BOPs. The space available for other BOP package components such as remote operated vehicle (ROV) panels and mounted controls equipment becomes harder to establish due to an increasing number and size of the accumulators required to be considered for operation in deeper water depths. The accumulators are also typically installed in series where the failure of any one accumulator prevents the additional accumulators from functioning.

The inefficiency of precharging accumulators under non-operational conditions thus requires large aggregate accumulator volumes that increase the size and weight of the subsea equipment. Yet, offshore rigs are moving further and further offshore to drill in deeper and deeper water. Because of the ever increasing envelope of operation, traditional accumulators have become unmanageable with regards to quantity and location. In some instances, it has even been suggested that in order to accommodate the increasing demands of the conventional accumulator system, a separate subsea skid may have to be run in conjunction with the subsea equipment in order to provide the required volume necessary at the limits of the water depth capability of the equipment. With rigs operators increasingly putting a premium on minimizing size and weight of the drilling equipment to reduce drilling costs, the size and weight of all drilling equipment must be optimized.

BRIEF DESCRIPTION OF THE DRAWINGS

For a more detailed description of the embodiments, reference will now be made to the following accompanying drawings:

FIG. 2 is a table listing examples of typical system operating depths;

DETAILED DESCRIPTION OF THE EMBODIMENTS

Figure 1:
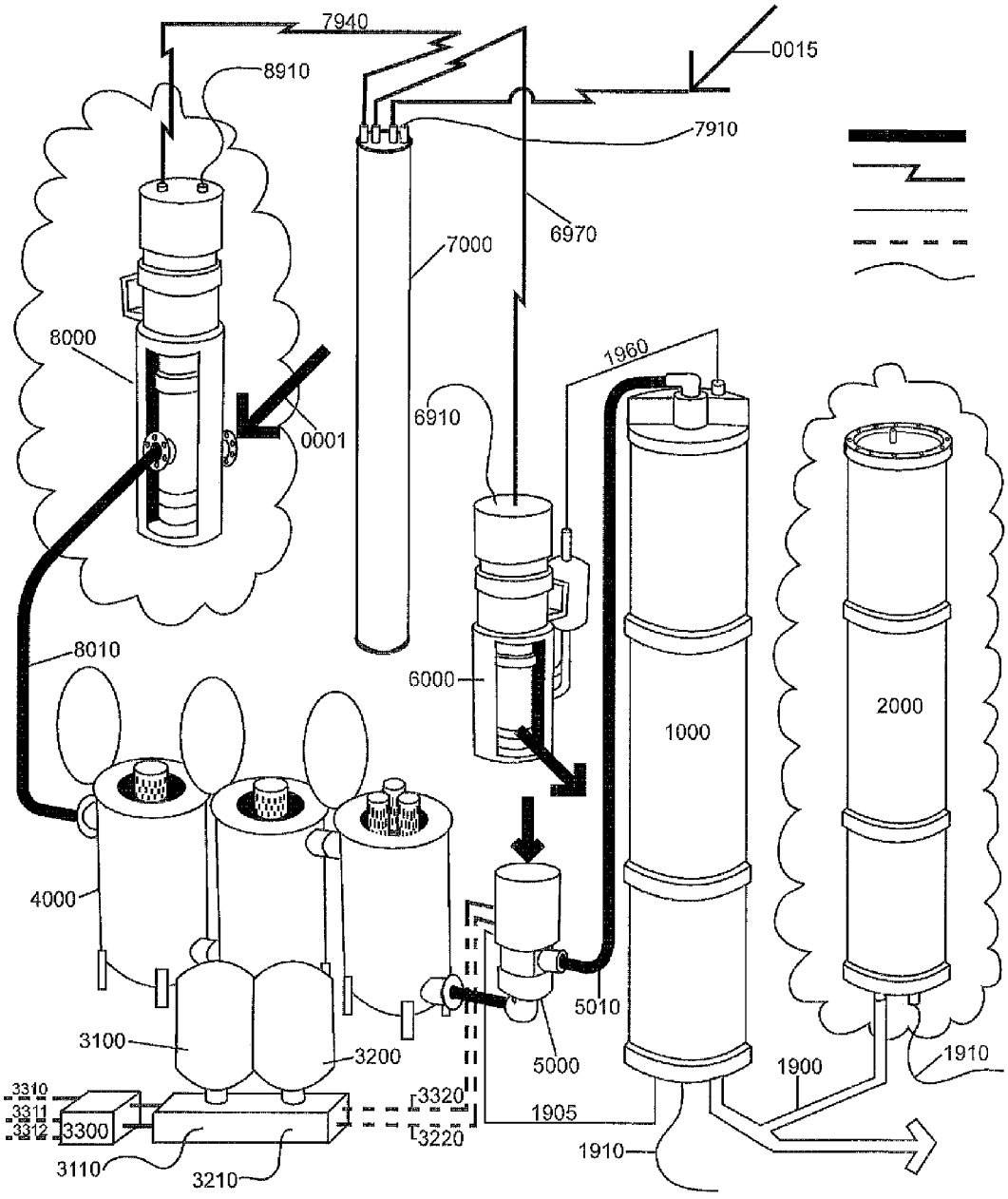
FIG. 1 is a system arrangement layout.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 illustrates an embodiment of an apparatus to manage underwater hydraulic and electrical power from fluid source 1900 and electrical source 0015; to fluid load 1900 and electrical load 6000; under remote hydraulic pilot control and remote electronic control. As shown in FIGS. 1 and 2, the accumulator 2000 is used to store fluid energy in water depths above the minimum hydrostatic operating depth. In water depths below the minimum hydrostatic operating depth, the intensifier 1000 is used to generate fluid energy. In water depths above the minimum hydrostatic operating depth, the fluid source 1900 is used to recharge the accumulator 2000. In water depths below the minimum hydrostatic operating depths and above the hydrostatic recharge depth, fluid source 1900 is used to recharge the intensifier 1000. In water depths below the hydrostatic recharge depth; fluid source 1900, the recharge pump 6000, and power pack 7000 are used to recharge the intensifier. During intensifier 1000 operation (generating fluid power), the regenerator 8000 is used to cogenerate electrical energy that is stored in the power pack 7000 for subsequent use. The power pack 7000 is otherwise charged from electrical source 0015 from a surface supply. The reference pilot accumulator 3200 is used to control the regulator 5000 to achieve desired fluid pressure from the intensifier 1000 when operated below the minimum hydrostatic operating depth. The screen 4000 is used to filter seawater that is used by the regulator 5000, intensifier 1000, and recharge pump 6000.

Figure 3:
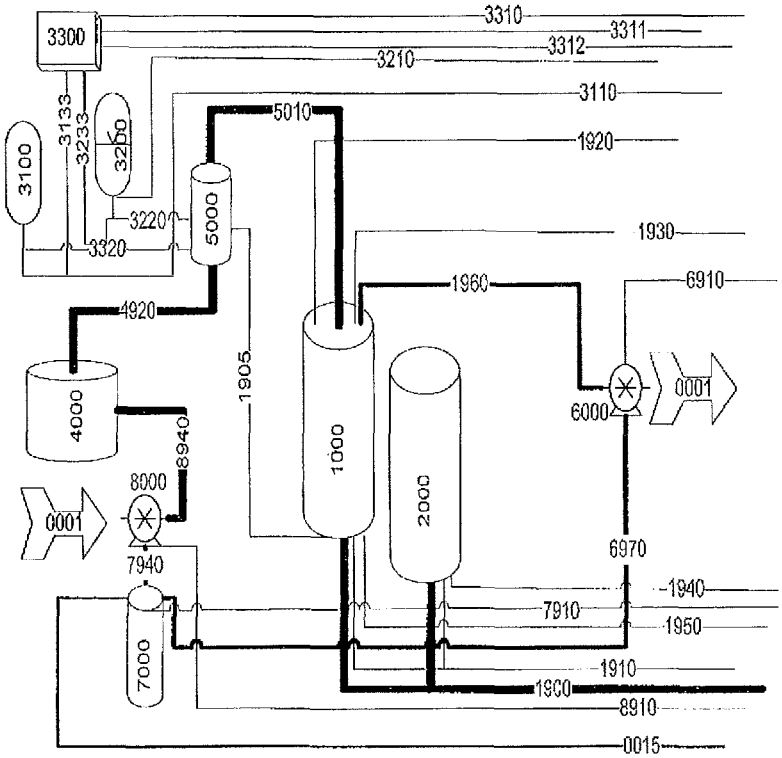
FIG. 3 is a diagram of a system architecture.
Figure 5:
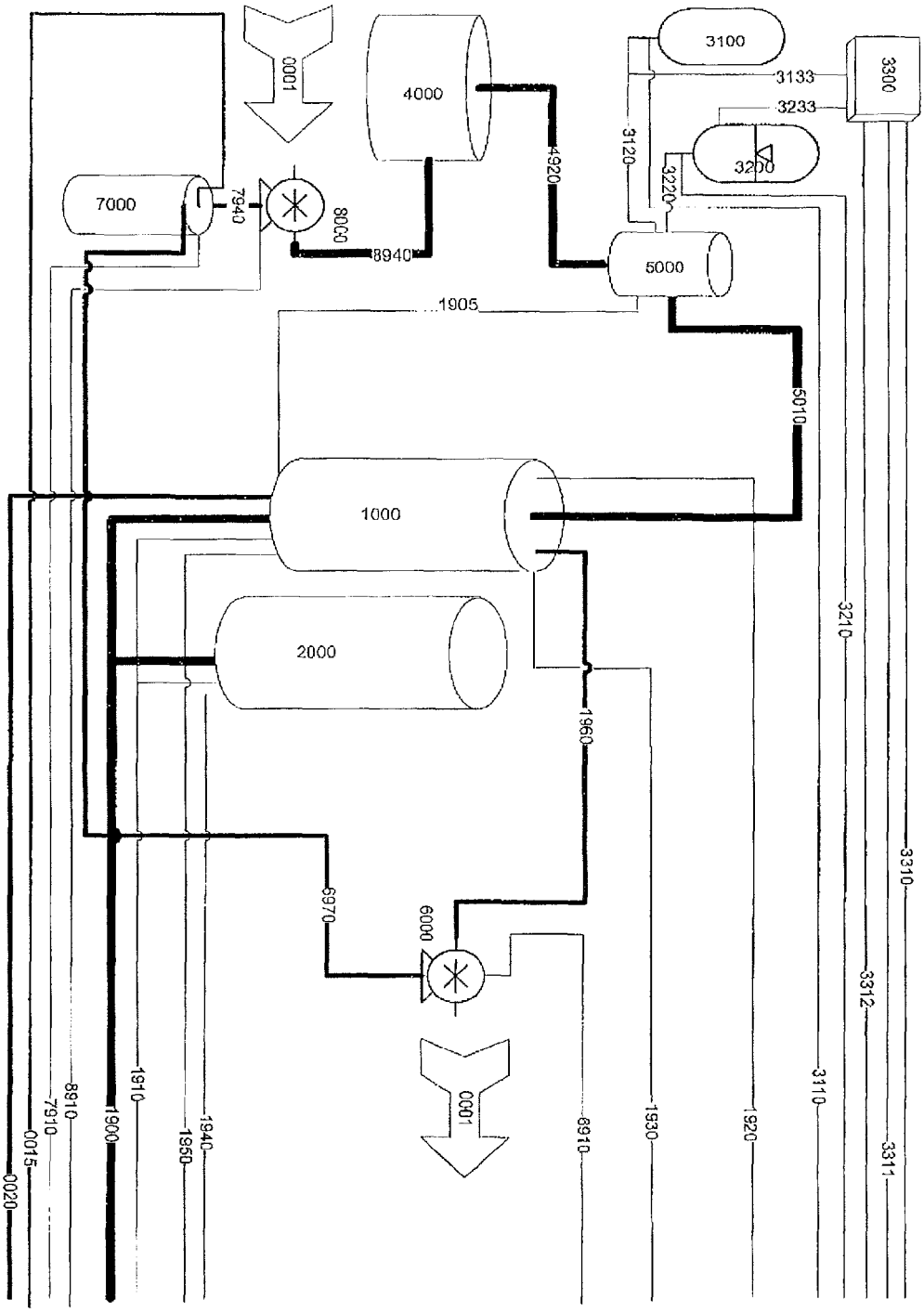
FIG. 5 is a system architecture with fluid recovery.

FIGS. 3 and 5 illustrate the system schematic without and with the use of an external delivery fluid recovery system.

FIG. 3 shows the arrangement of intensifier 1000, accumulator 2000, screen 4000, regulator 5000, regenerator 8000, reference reservoir 3100, reference pilot accumulator 3200, reference pump 3300, recharge pump 6000, seawater at ambient pressure, and subsea fluid header 1900. The subsea fluid header 1900 operates at the maximum delivery fluid pressure of the accumulator 2000. As pressure in the subsea fluid header 1900 drops to below the intensifier 1000 delivery pressure, the regulator 5000 allows seawater to enter the intensifier 1000, sufficient to generate and maintain the intensifier 1000 delivery pressure as delivery fluid is consumed from the intensifier 1000 by operation of the underwater equipment.

FIG. 3 also illustrates interconnections between the equipment. The reservoir 3100 is connected to the reference pump 3300 via instrument tubing run 3133. The pilot accumulator 3200 is connected to the reference pump 3300 via instrument tubing run 3233. The reservoir 3100 is connected to the regulator 5000 via instrument tubing run 3320. The pilot accumulator 3200 is connected to the regulator 5000 via instrument tubing run 3220. The regulator 5000 is connected to the intensifier 1000 by instrument tubing run 1905 and large diameter tubing run 5010. The power pack 7000 is connected to the recharge pump 6000 via pressure balanced multiconductor electrical cable 6970. The recharge pump 6000 is connected to the intensifier 1000 via medium diameter tubing run 1960. The regenerator 8000 is connected to the power pack 7000 via high current medium voltage pressure balanced electrical power cable 7940.

The regenerator 8000 utilizes the seawater consumed by the intensifier 1000 when developing delivery fluid power, to cogenerate electrical power which is stored by the power pack 7000. The seawater exhaust of the regenerator 8000 is connected to the screen 4000 input bell flange.

The screen 4000 filters seawater that flows from the surrounding ambient environment to flow through the regenerator 8000 and subsequently to the regulator 5000.

The regulator 5000 regulates the flow of seawater 0001 to the intensifier 1000 to maintain intensifier 1000 delivery pressure; utilizing a pilot pressure reference 3220 from the reference pilot accumulator 3200, feedback 1905 from the intensifier 1000 delivery fluid pressure, and hydrostatic ambient pressure. The regulator 5000 uses, for example, a one-atmosphere reference reservoir 3100 to allow the regulator 5000 to respond to changes in intensifier delivery fluid pressure 1905. The output pressure from the regulator 5000 is at or below ambient hydrostatic pressure.

The reference pilot accumulator 3200 pressure is adjustable through the use of the reference pump 3300, which allows hydraulic control fluid to be pumped from the reference reservoir 3100 to the reference pilot accumulator 3200 and vice versa via connections 3133 and 3233; in order to change the pressure within the gas charged reference pilot accumulator 3200. The reference pump 3300 is operated by an external underwater control system through hydraulic valve pilot signals Ref Pump Stroke A 3310 and Ref Pump Stroke B 3311, the direction of pressure increase through hydraulic valve pilot signals pilot accumulator pressure increase/decrease 3312.

The reference pilot accumulator 3200 and reference reservoir 3100 incorporate pressure transducers to allow an external control system to monitor reference pressures via the pilot pressure transducer cable 3210 and the reservoir pressure transducer cable 3110.

The intensifier 1000 is operated as a pressure intensifying pump, where regulated seawater pressure (below ambient hydrostatic pressure) is multiplied to a delivery fluid pressure exceeding ambient hydrostatic pressure. Based on installed geometry constraints, desired minimum hydrostatic operating depth, and volumetric delivery constraints, this embodiment uses an intensification factor of 2.2. However, other intensification factors may be appropriate depending on the operating parameters and environment. The intensifier 1000 may be isolated from the regulator 5000 utilizing the regulator isolation valve pilot line 1920 from an external control system. The intensifier 1000 may be isolated from the delivery fluid output and fill header 1900 utilizing the intensifier isolation valve pilot control from an external control system. The intensifier 1000 may be isolated from the recharge pump 6000 utilizing the recharge pump isolation valve pilot 1930 control from an external control system. The intensifier 1000 delivery pressure and volume measurement is available to an external control system via the intensifier instrument communications and power cable 1910.

The recharge pump 6000 is used to evacuate seawater from the intensifier 1000, in order to refill the intensifier 1000 from the subsea fluid header 1900, when the intensifier 1000 is used below the minimum hydrostatic recharge water depth. The recharge pump 6000 utilizes electrical power stored in the power pack 7000. The recharge pump 6000 operation is controlled via the recharge pump instrument power and communications cable 6910 to an external underwater control system.

The power pack 7000 is used to store electrical power from either or both surface electrical supply 0015 and from the regenerator 8000. The power pack 7000 is controlled via the power pack instrument power and communications cable 7910 to an external underwater control system.

Once the intensifier 1000 is depleted of delivery fluid, the regulator 5000 is isolated from the intensifier 1000 via operation of the intensifier isolation pilot hydraulic signal 1950 from an external underwater control system. The recharge pump 6000 is operated via the recharge pump instrument communications and power control interface 6910, to evacuate seawater from the intensifier 1000 and allowing the intensifier 1000 to withdraw delivery fluid from the subsea fluid header 1900 under pressure from the surface. In water depths below minimum hydrostatic delivery operation and above minimum hydrostatic recharge operation, the use of the recharge pump 6000 is not required, as a sufficient pressure differential exists between the surface supplied delivery fluid output and fill header 1900 and ambient hydrostatic pressure to allow the delivery fluid output and fill header 1900 to push the seawater out of the Intensifier. Below the minimum hydrostatic recharge depth, it is necessary to augment the delivery fluid output and fill header 1900 pressure, through evacuation of seawater from the intensifier 1000 by the recharge pump 6000.

Figure 4:
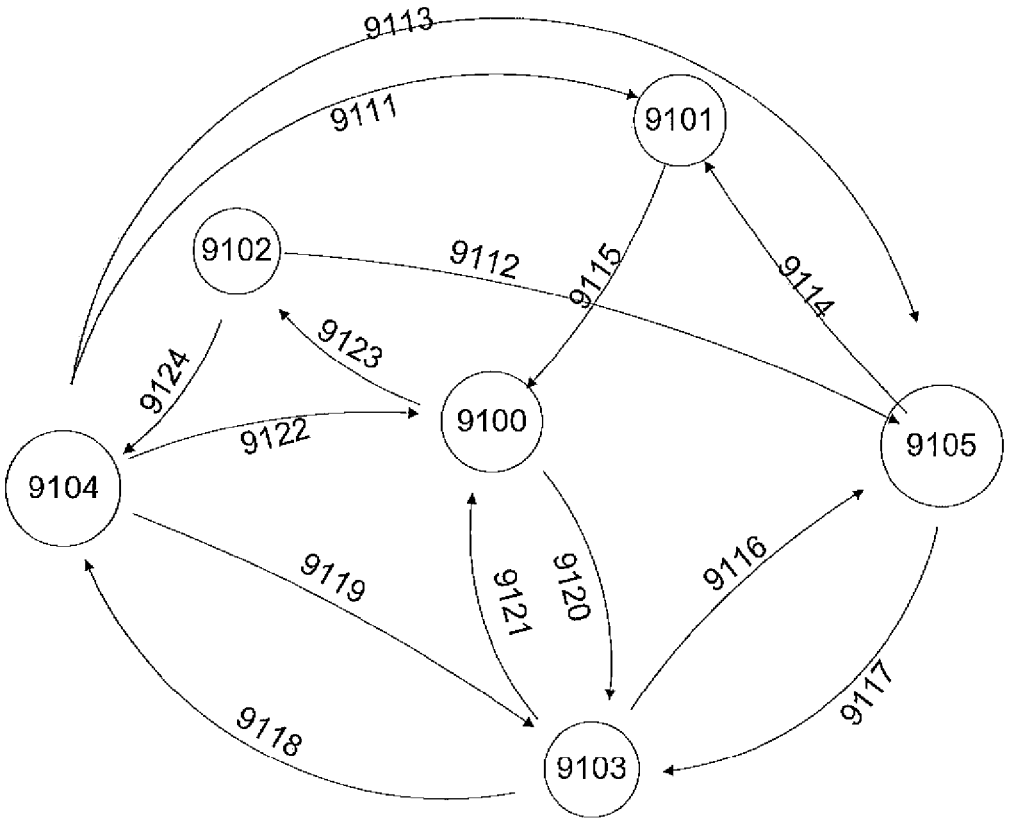
FIG. 4 is an intensifier based system state transition diagram.

FIG. 4 describes the operation of the intensifier 1000 in the form of a state transition diagram, with the following states: idle full 9101, idle empty 9102, idle transit 9103, hydro discharge 9100, header overpressure recharge 9104, and header underpressure recharge 9105. Idle full 9101 indicates a state where the intensifier 1000 is full of delivery fluid and under pressure control of the regulator 5000 and capable of discharging delivery fluid, but under no delivery fluid demand from the underwater control system. Idle empty 9102 indicates a state where the intensifier 1000 is empty of fluid and under pressure control of the regulator 5000, but no longer able to discharge delivery fluid to the underwater control system. Idle transit 9103 indicates a state where the intensifier 1000 is discharging delivery fluid under regulator 5000 control to the underwater control system. Overpressure recharge 9104 is a state where the intensifier 1000 is no longer under regulator 5000 control and withdrawing delivery fluid from delivery fluid output and fill header 1900. Underpressure recharge 9105 is a state where the intensifier 1000 is no longer under regulator 5000 control, and withdrawing delivery fluid from the delivery fluid output and fill header 1900 with assistance from the recharge pump 6000 evacuating seawater from the intensifier 1000. Transitions between states are described as causes for the transition. Transition 9115 occurs when the intensifier 1000 is not full and the regulator isolation valve pilot 1920 is not active or engaged. Transition 9114 occurs when the intensifier 1000 is full and the regulator isolation valve pilot 1920 is not active or engaged and the recharge pump 6000 is not running. Transition 9117 occurs when the regulator isolation valve pilot 1920 is not active or engaged and the recharge pump 6000 is not running. Transition 9118 occurs when the regulator isolation valve pilot 1920 is active or engaged and the pump isolation valve pilot 1930 is active or engaged and the recharge pump 6000 is not running. Transition 9119 occurs when the regulator isolation valve pilot 1920 is not active or engaged. Transition 9116 occurs when the regulator isolation valve pilot 1920 is active or engaged and the recharge pump 6000 is running. Transition 9120 occurs when no change in intensifier 1000 volume is detected. Transition 9121 occurs when a decrease in intensifier 1000 volume is detected. Transition 9123 occurs when the intensifier 1000 volume is empty. Transition 9124 occurs when the regulator isolation valve pilot 1920 is active or engaged. Transition 9122 occurs when the regulator isolation valve pilot 1920 is not active or engaged. Transition 9112 occurs when the regulator isolation valve pilot 1920 is active or engaged and the recharge pump 6000 is running. Transition

9111 occurs when the intensifier 1000 volume is full and the regulator isolation valve pilot 1920 is not active or engaged. Transition 9113 occurs when the recharge pump 6000 is running.

FIG. 5 shows a variation of the system that incorporates the capability of withdrawing delivery fluid from either the delivery fluid output and fill line 1900, or from an external fluid recovery underwater storage tank line 0020 that feeds from an underwater storage tank (not shown).

Figure 6:
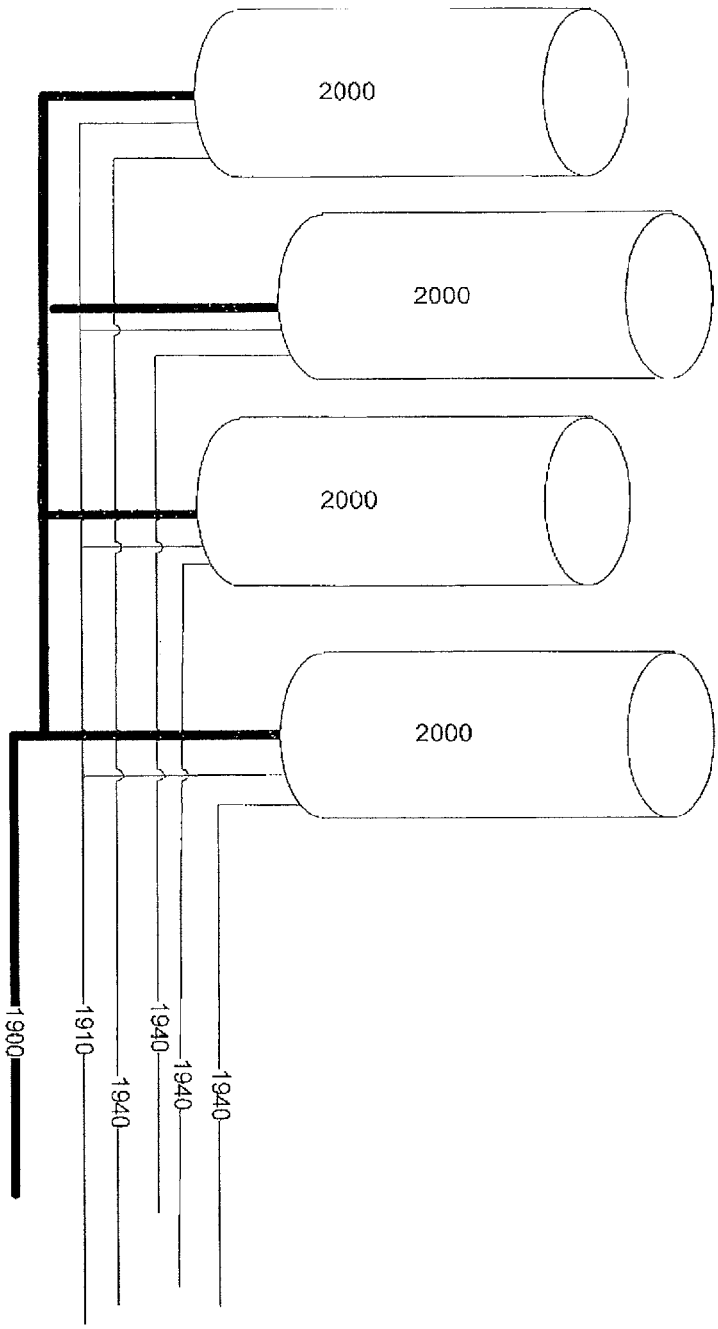
FIG. 6 is an accumulator system configuration.

FIG. 6 illustrates a system configuration to be used exclusively above the minimum hydrostatic operating depth of the system, where the accumulators 2000 are used to store delivery fluid at the operating pressure of the delivery fluid input and fill header 1900. Hydraulic accumulator isolation valve pilots 1940 are provided from the external underwater control system to allow for individual isolation capabilities. The accumulator instrument communications and power cable 1910 to the external underwater control system allows for communication of individual pressure measurement and individual fluid level measurement within the accumulators 2000.

Figure 7:
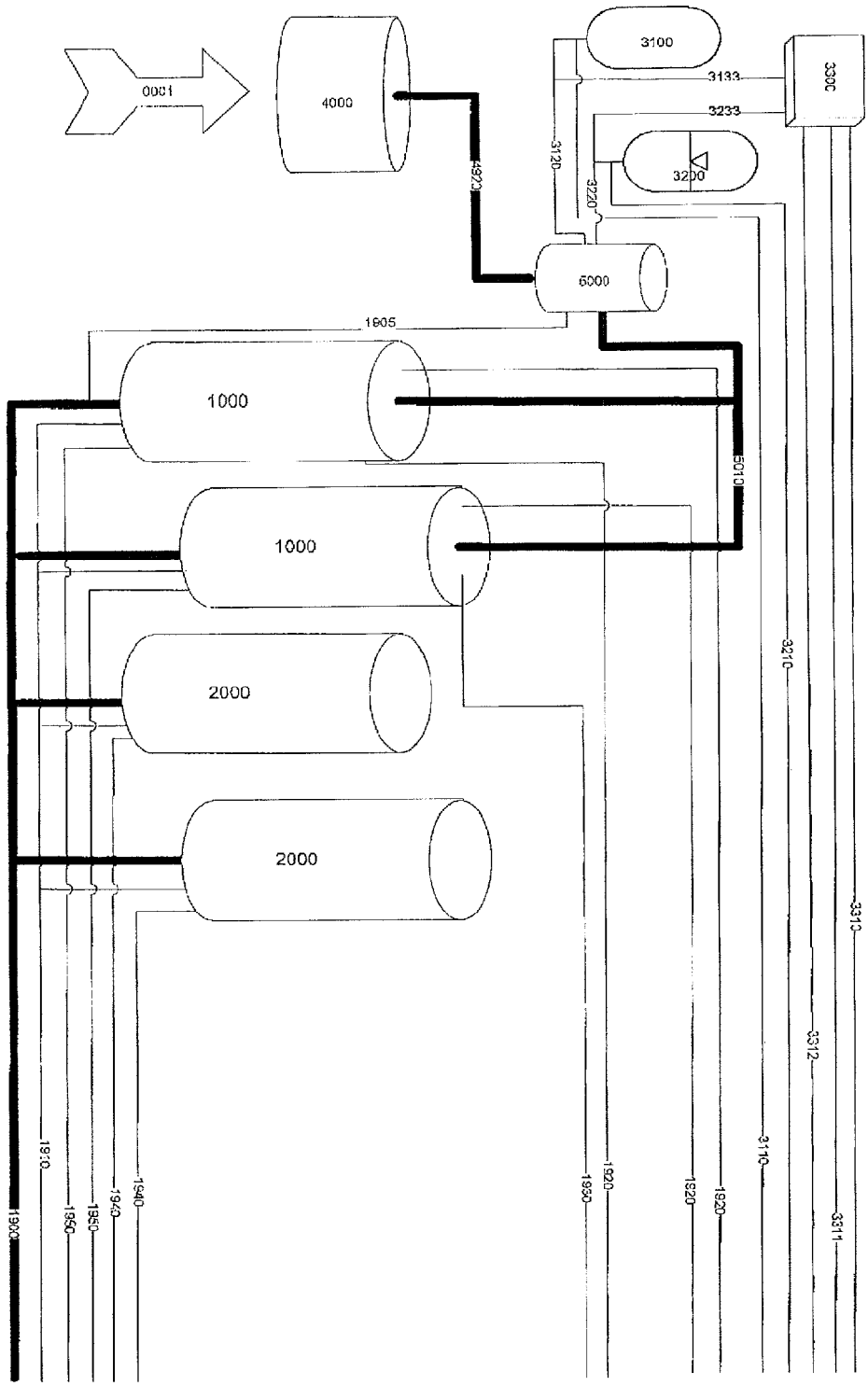
FIG. 7 is a hybrid system configuration.

FIG. 7 illustrates a system configuration to be may used above the minimum hydrostatic recharge depth of the system, where the accumulators 2000 are used to store delivery fluid at the operating pressure of the delivery fluid input and fill header 1900 and intensifiers 1000 are used to generate delivery fluid power below the minimum hydrostatic operating depth. Hydraulic accumulator isolation valve pilot signals 1940 are provided from the external underwater control system to allow for individual accumulator isolation capabilities. Hydraulic regulator isolation valve pilot 1920 signals are provided from the external underwater control system to allow for individual recharge capabilities of the intensifiers 1000. Hydraulic recharge pump isolation valve pilot 1930 signals are provided from the external underwater control system to allow for individual recharge capabilities of the intensifiers 1000. Hydraulic intensifier isolation valve pilot 1950 signals are provided from the external underwater control system to allow for individual intensifier isolation capabilities. The intensifier accumulator instrument communications and power cable 1910 to the external underwater control system allows for communication of individual pressure measurement and individual fluid level measurement within the accumulators 2000, and individual pressure and volume measurement within the intensifiers 1000.

Figure 8:
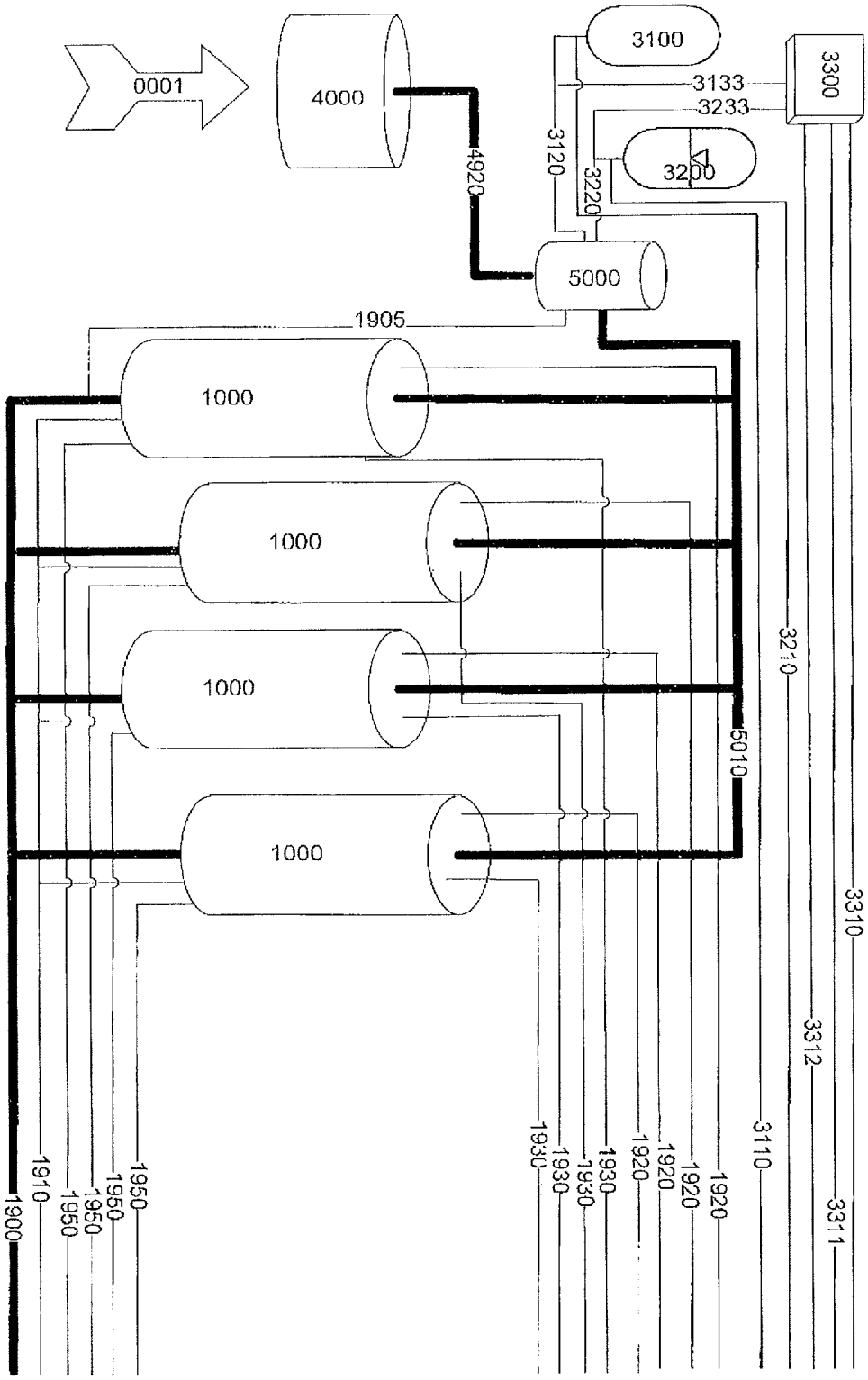
FIG. 8 is an intensifier configuration.

FIG. 8 illustrates a system configuration to be may used exclusively below the minimum hydrostatic operating depth and above the minimum hydrostatic recharge depth of the system, where the intensifiers 1000 are used to generate delivery fluid power. Hydraulic regulator isolation valve pilot 1920 signals are provided from the external underwater control system to allow for individual recharge capabilities of the intensifiers 1000. Hydraulic recharge pump isolation valve pilot 1930 signals are provided from the external underwater control system to allow for individual recharge capabilities of the intensifiers 1000. Hydraulic intensifier isolation valve pilot 1950 signals are provided from the external underwater control system to allow for individual intensifier isolation capabilities. The intensifier instrument communications and power cable 1910 to the external underwater control system allows for communication of individual pressure measurement and individual fluid level measurement within the intensifiers 1000.

Figure 9:
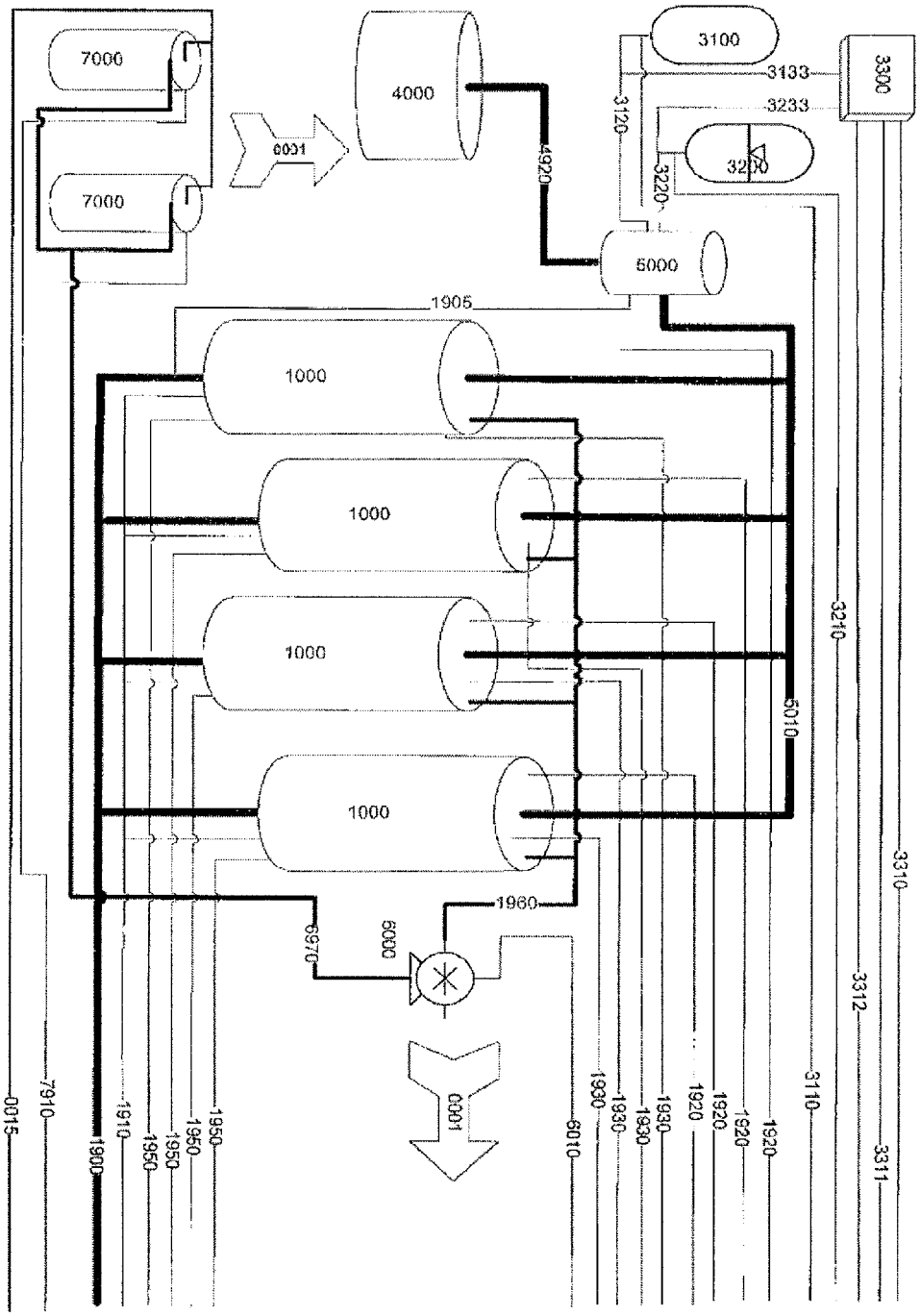
FIG. 9 is an intensifier with a recharge pump configuration.

FIG. 9 illustrates a system configuration to be used below the minimum hydrostatic operating depth, where the intensifiers 1000 are used to generate delivery fluid power and the recharge pump 6000 and power pack 7000 are used to individually recharge the intensifiers 1000. Hydraulic regulator isolation valve pilot 1920 signals are provided from the external underwater control system to allow for individual recharge capabilities of the intensifiers 1000. Hydraulic recharge pump isolation valve pilot 1930 signals are provided from the external underwater control system to allow for individual recharge capabilities of the intensifiers 1000. The hydraulic intensifier isolation valve pilot 1950 signals are provided from the external underwater control system to allow for individual intensifier isolation capabilities. The intensifier instrument communications and power cable 1910 to the external underwater control system allows for communication of individual pressure measurement and volume measurement within the intensifiers 1000.

Figure 10:
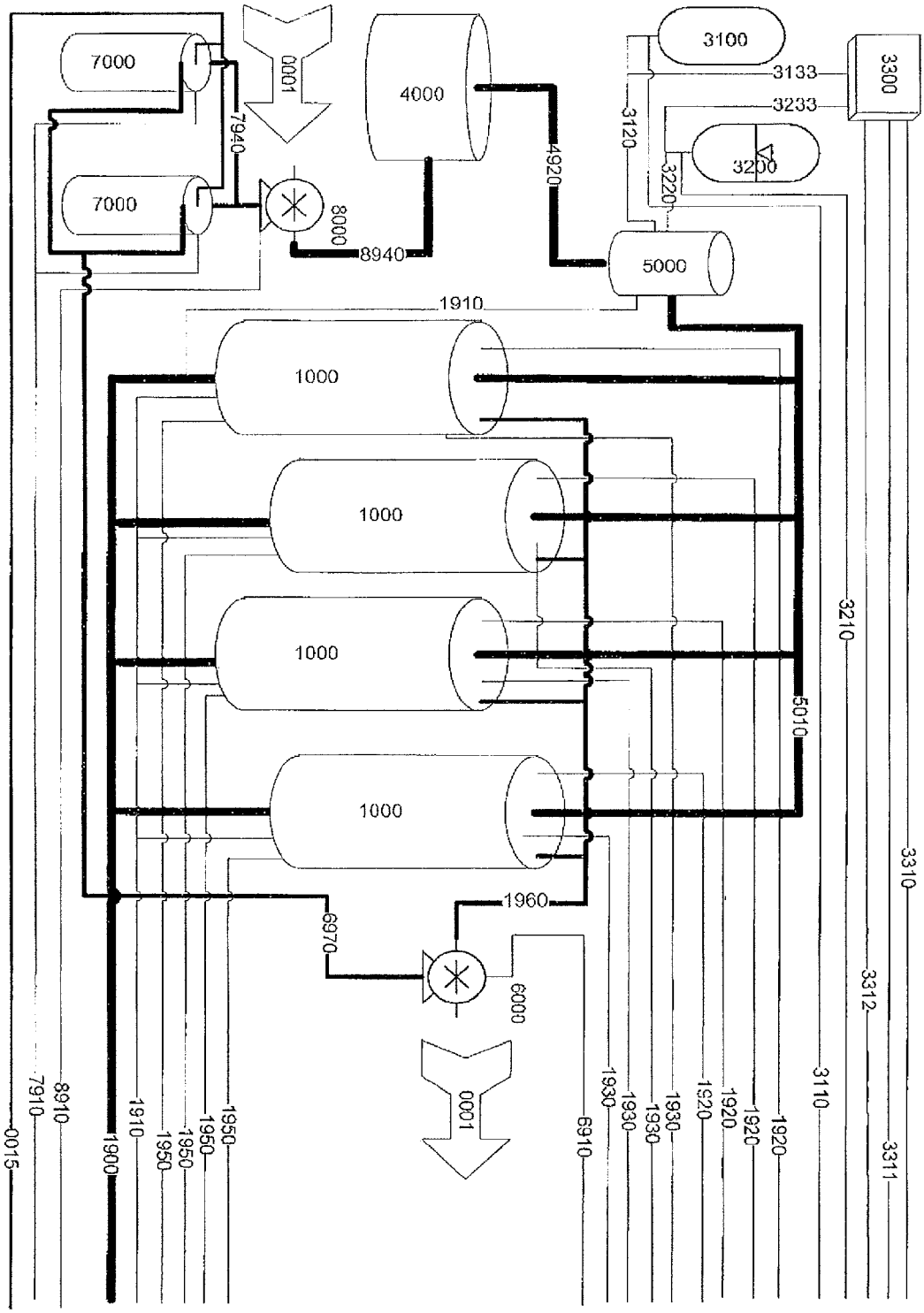
FIG. 10 is an intensifier with regenerative electrical power.

FIG. 10 illustrates a system configuration to be used below the minimum hydrostatic operating depth, where the intensifiers 1000 are used to generate delivery fluid power and the recharge pump 6000 and power pack 7000 are used to individually recharge the intensifiers 1000. The regenerator 8000 is used to augment power pack 7000 recharge time and surface electrical supply current demand 0015. Hydraulic regulator isolation valve pilot 1920 signals are provided from the external underwater control system to allow for individual recharge capabilities of the intensifiers 1000. Hydraulic recharge pump isolation valve pilot 1930 signals are provided from the external underwater control system to allow for individual recharge capabilities of the Intensifiers. The hydraulic intensifier isolation valve pilot 1950 signals are provided from the external underwater control system to allow for individual intensifier isolation capabilities. The intensifier instrument communications and power cable 1910 to the external underwater control system allows for communication of individual pressure measurement and volume measurement within the Intensifiers. The regenerator instrument communications and power cable 8910 is used to monitor and control the regenerator 8000. The power pack instrument communications and power cable 7910 is used to monitor and control the power pack 7000. The recharge pump instrument communications and power cable 6910 is used to monitor and control the recharge pump 6000.

Figure 11:
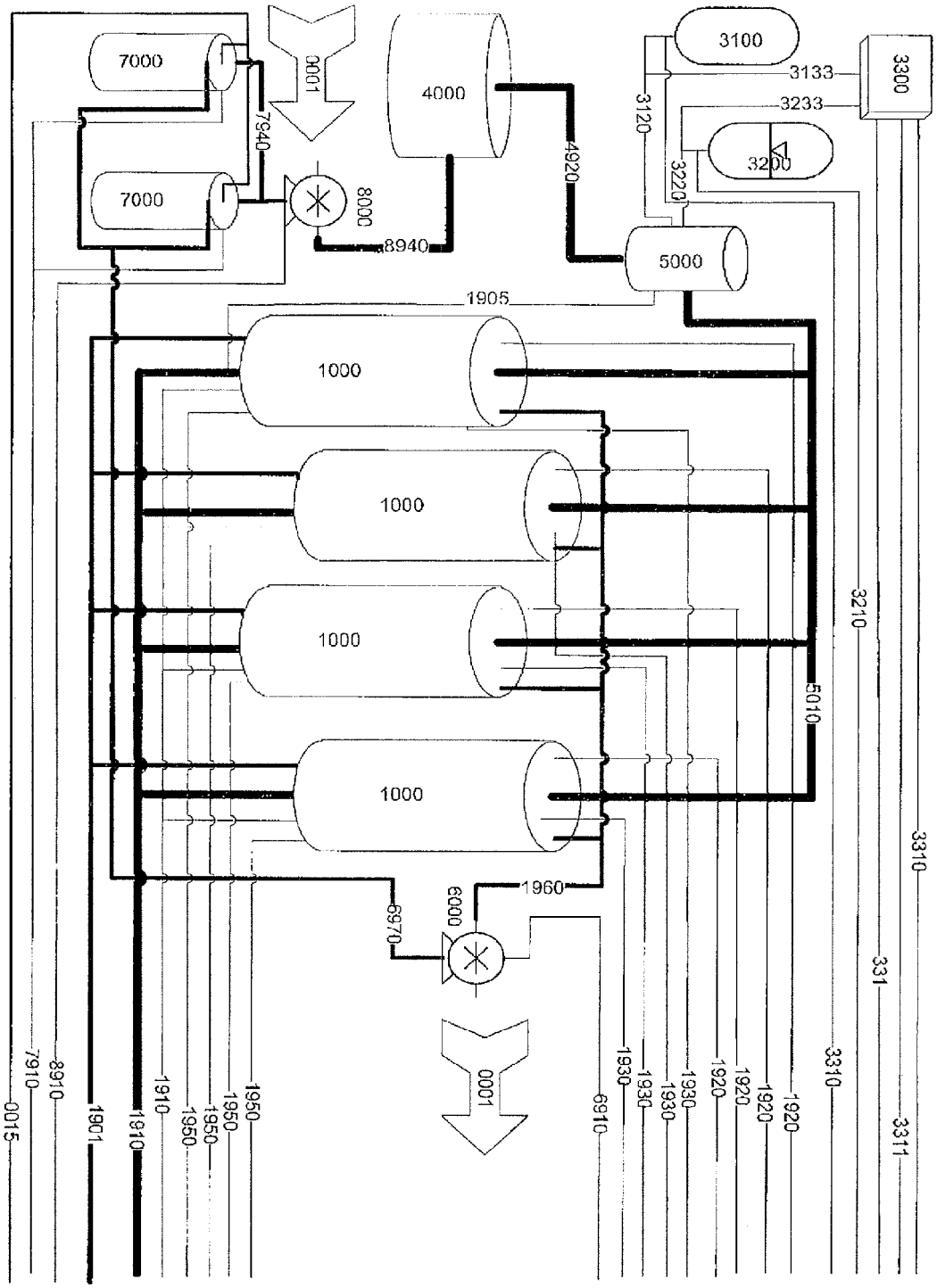
FIG. 11 is an intensifier with regenerative electrical power and fluid recovery.

FIG. 11 illustrates a system configuration to be used below the minimum hydrostatic operating depth, where the intensifiers 1000 are used to generate delivery fluid power and the recharge pump 6000 and power pack 7000 are used to individually recharge the intensifiers 1000. The intensifiers 1000 utilize a replacement subplate mounted valve, in lieu of the hydraulic isolation valve to allow selection of delivery fluid for recharge, from either the subsea fluid header 1900, or from an external fluid recovery reservoir via the recovery fluid header 1901. The regenerator 8000 is used to augment power pack 7000 recharge time and surface electrical supply current demand 0015. Hydraulic regulator isolation valve pilot 1920 signals are provided from the external underwater control system to allow for individual recharge capabilities of the Intensifiers. Hydraulic recharge pump isolation valve pilot 1930 signals are provided from the external underwater control system to allow for individual recharge capabilities of the intensifiers 1000. Hydraulic intensifier selection valve pilot 1950 signals are provided from the external underwater control system to allow for individual intensifier isolation and recharge capabilities. The intensifier instrument communications and power cable 1910 to the external underwater control system allows for communication of individual pressure measurement and volume measurement within the intensifiers 1000.

Figure 12:
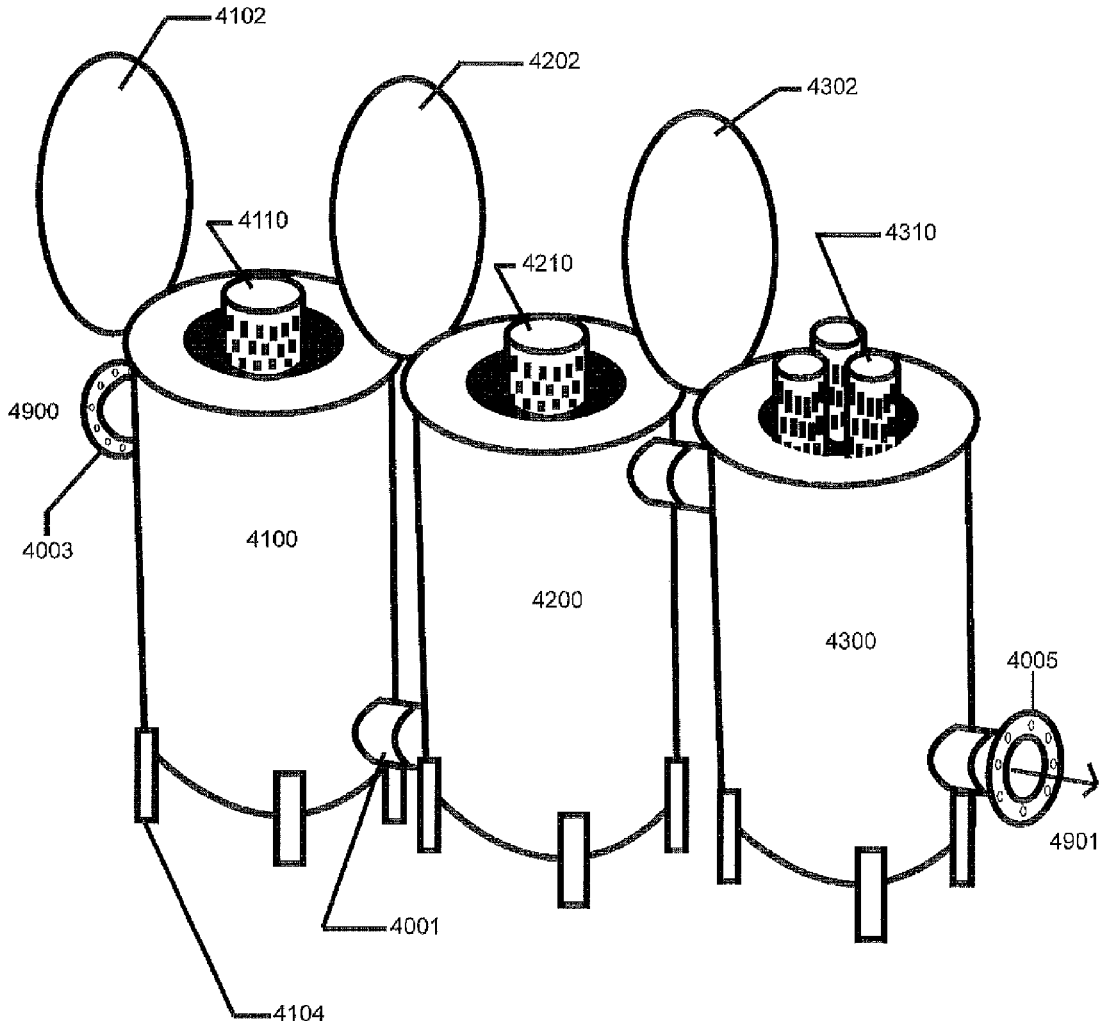
FIG. 12 is a screen assembly.

FIG. 12 illustrates the arrangement of the screen 4000 comprised of as assembly of coarse housing 4100, medium housing 4200, and fine housing 4300. The coarse housing 4100 and medium housing 4200 are joined by flange 4100, and the medium housing 4200 and fine housing 4300 are joined by flange 4102. The inlet to the screen 4000 is indicated by the inlet flange 4003. The outlet from the screen 4000 is indicated by the outlet flange 4005. The coarse housing 4100, medium housing 4200, and fine housing 4300 have mounting feet 4104 to allow the housings to be permanently mounted to a supporting structure. The housings have maintenance lids 4102, 4202, and 4302 to allow access to replaceable filter media in the respective housings. The coarse housing 4100 contains a replaceable coarse filter 4110, designed to accommodate a flow rate of 600 gallons per minute, with a volume of 60,000 gallons throughput, and hold 2 lbs of particulate matter, and a Taylor mesh size of 250. The medium housing 4200 contains a replaceable medium filter 4210, designed to accommodate a flow rate of 600 gallons per minute, with a volume of 60,000 gallons throughput, and hold 3 lbs of particulate matter, and a Taylor mesh size of 28. The fine housing 4300 contains a replaceable fine filter 4310, designed to accommodate a flow of 600 gallons per minute, with a volume of 60,000 gallons, hold 5 lbs of particulate matter, and a Taylor mesh size of 9. The screen 4000 is designed for a flow rate of 600 gallons per minute, a total volume of 60,000 gallons throughput; hold a total of 10 lbs of seawater particulate contaminants, with a total pressure drop of 100 psi. It should be appreciated that these filter configurations are examples and that other filter configurations may be used as well.

The regulator 5000 is a non-relieving, seawater service flow and negative pressure regulator. It is used in conjunction with the Intensifier to supply regulated seawater pressure at or below hydrostatic pressure to cause the Intensifier to deliver hydraulic control fluid at a specific pressure above hydrostatic pressure. The regulator 5000 utilizes hydrostatic pressure, feed forward differential pressure reference, and feed back intensifier 1000 fluid pressure to maintain downstream seawater pressure at or below hydrostatic pressure during low or high flow conditions during delivery fluid consumption by the subsea control system. The regulator 5000 is designed to relieve to ambient (hydrostatic pressure) when the downstream pressure exceeds hydrostatic pressure. The regulator 5000 utilizes the pilot accumulator 3220 pressure reference for its feed forward reference. The regulator 5000 utilizes the hydraulic pressure delivery 1950 of the intensifier 1000 to provide monotonical sum of error and gain associated with reductions of delivery fluid pressure 1900.

Figure 13:
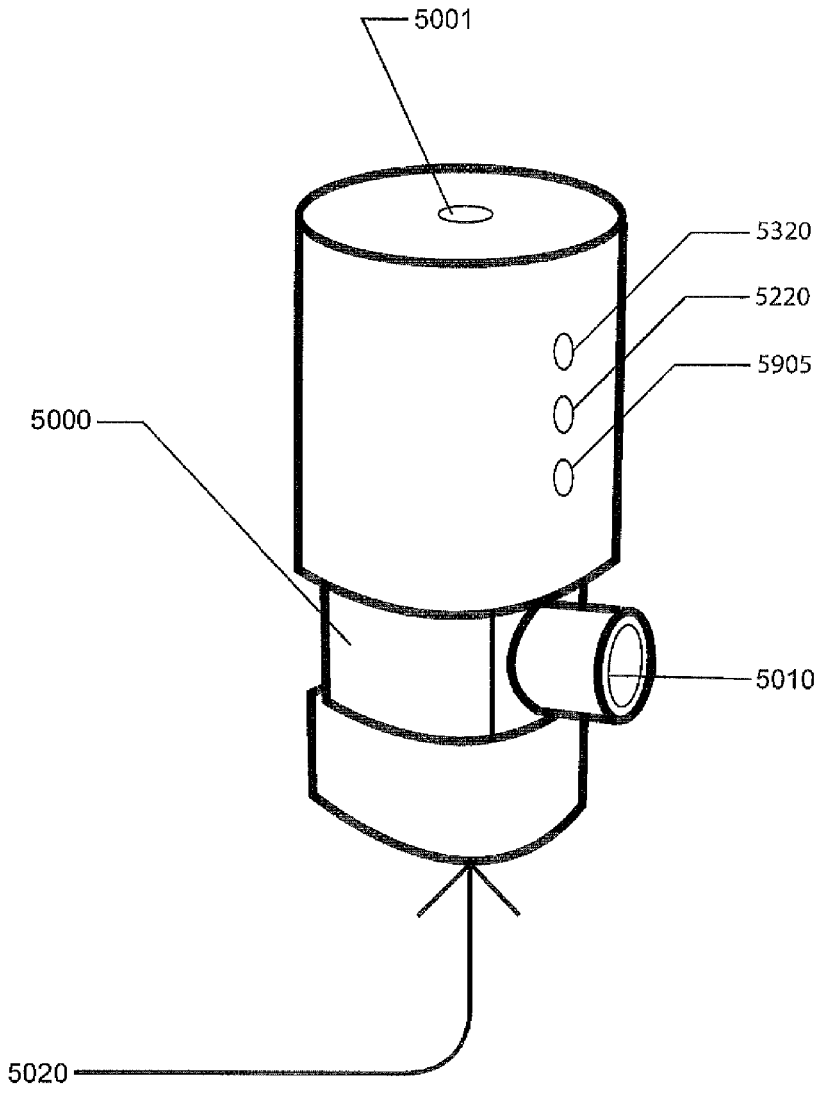
FIG. 13 is a regulator assembly.

FIG. 13 illustrates the field connections of the regulator 5000. Unregulated ambient pressure seawater enters the regulator 5000 from the screen 4000 at the inlet split flange 5020 and inlet seal sub 5016. Seawater at regulated pressure at or below ambient pressure conditions exits the regulator 5000 at the outlet split flange 5025 and outlet seal sub 5016. Gage reference pressure is applied from the pilot accumulator 3200 at tubing port 5220. Feedback pressure from the intensifier 1000 delivery fluid port is applied at tubing port 5905. Reservoir 3300 circulation at one atmosphere pressure is applied at tubing port 5320.

Figure 14:
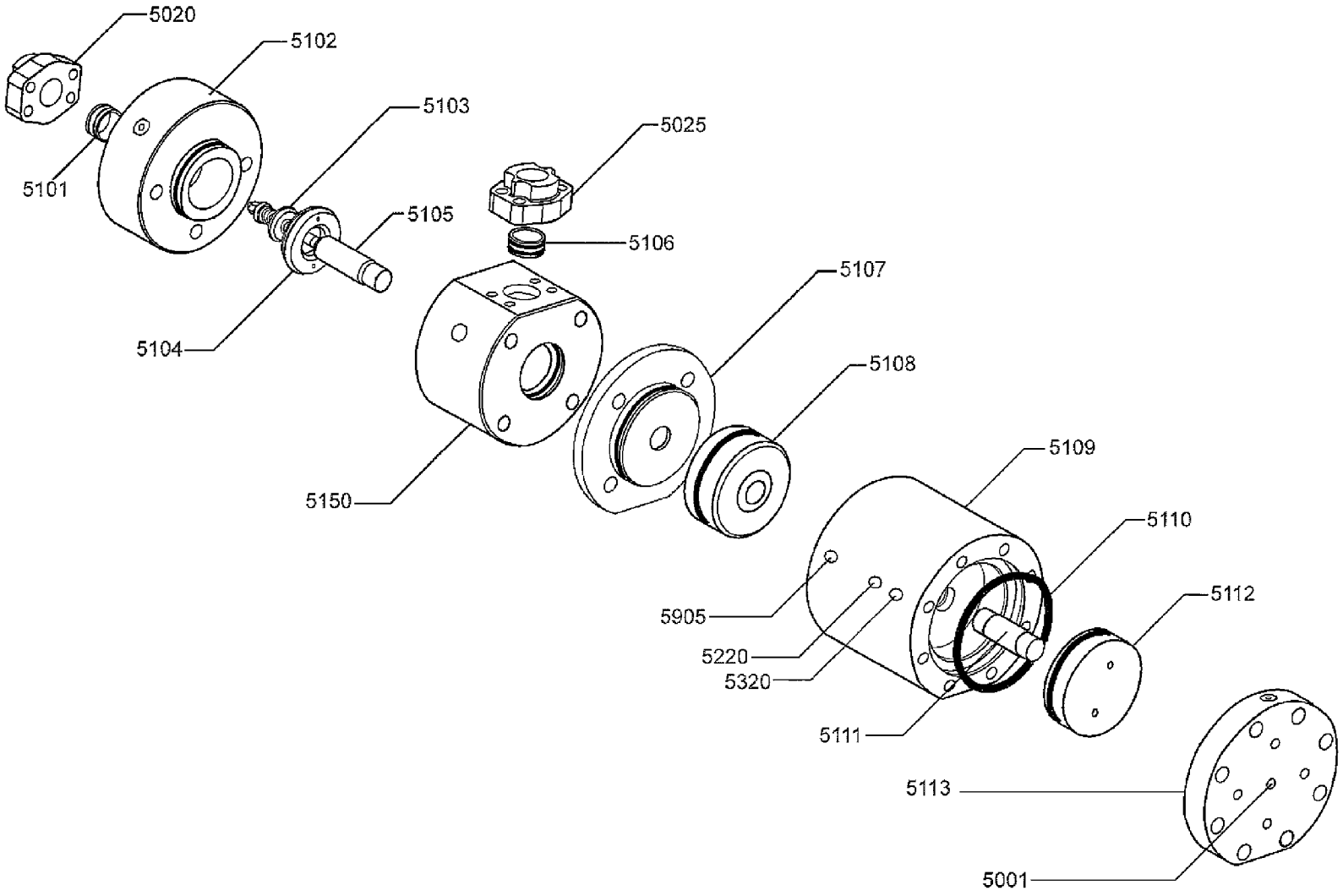
FIG. 14 is an exploded view of a regulator.

FIG. 14 illustrates an exploded view of the regulator 5000, comprised of an end cylinder cap 5113 with seawater inlet port 5001; a cylinder body 5109 internally chambered for end piston 5112 and front piston 5108 with piston rod 5111 through subdividing bulkhead; an end cap seal 5110; a front cylinder cap 5107; a flow body 5150; a flow body cap; an inlet flow body seal sub 5101; an inlet regulator split flange port 5020; an outlet flow body seal sub 5106; and an outlet regulator split flange port 5025. The internal arrangement of an end piston 5112 connected to piston rod 5111; front piston 5108 connected to piston rod 5111 and poppet assembly 5105. Seawater inlet port 5001 has access to a volume of seawater between the end piston 5112 and end cylinder cap 5113. Reservoir port 5320 has access to a volume of hydraulic fluid between the subdividing bulkhead of the cylinder body 5109 and the end piston 5112. Pilot pressure port 5220 has access to a volume of hydraulic fluid between the subdividing bulkhead of the cylinder body 5109 and the front piston 5108. Feedback port 5905 has access to a volume of hydraulic fluid between the front piston 5108 and the front cylinder cap. The poppet assembly 5105 rod passes through the front cylinder cap.

Figure 15:
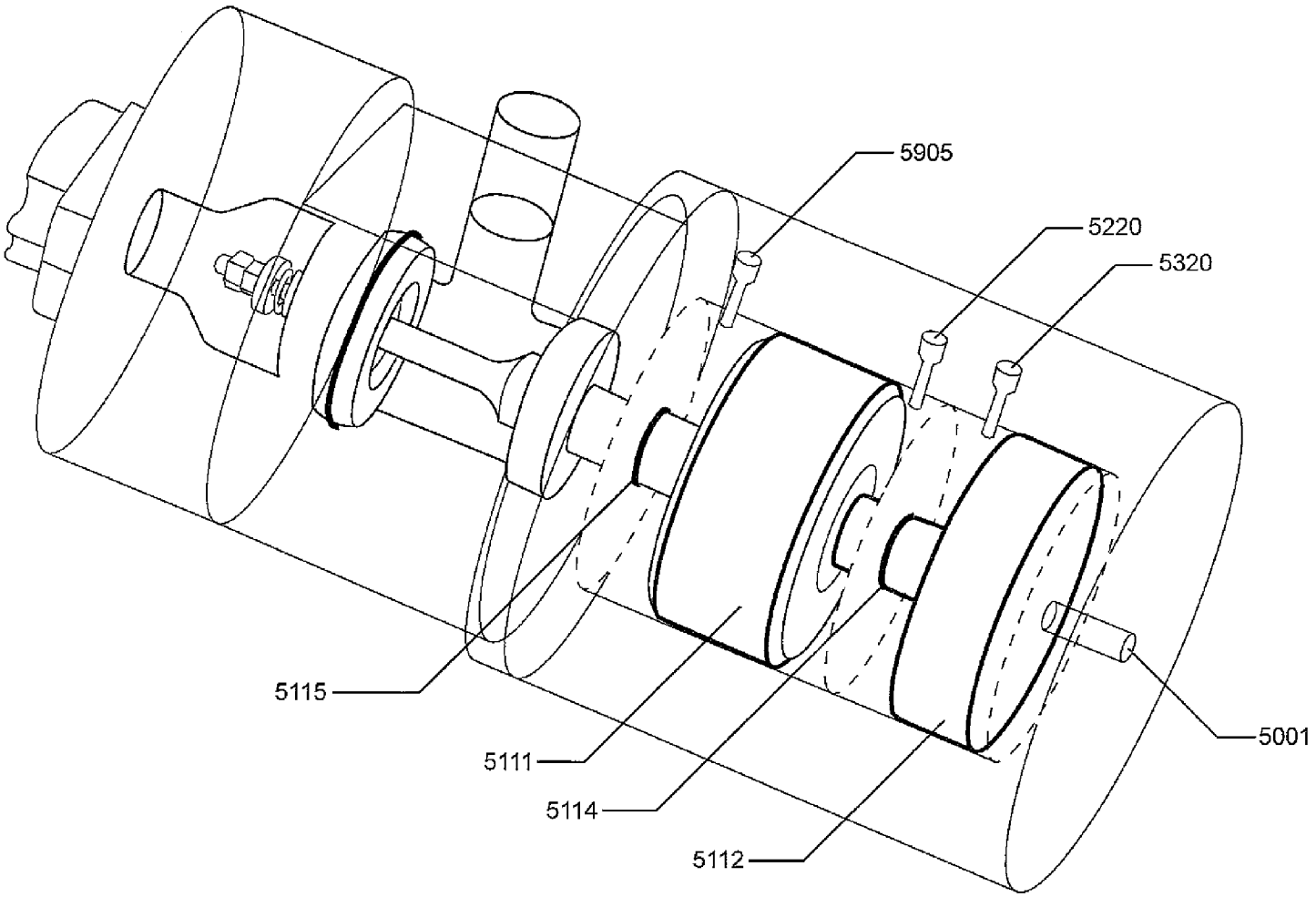
FIG. 15 is a cutaway view of a regulator.

FIG. 15 illustrates a cutaway of the regulator 5000. End piston 5112, piston rod 5111, front piston 5108, and the poppet assembly 5105 are interconnected. Moving of this assembly towards the seawater inlet port causes the poppet to open and allow seawater to move into the flow body 5150 and vice versa. A constant hydrostatic force $F_{end}$ is applied to the end piston 5112 via the seawater inlet port 5001 biasing the poppet assembly 5105 to open. A constant gage pressure force $F_{acc}$ derived from the pilot accumulator 3200 pressure is applied to the front piston 5108 biasing the poppet assembly 5105 to open. A variable absolute pressure force $F_{int}$ derived from the intensifier delivery pressure 1905 is applied to the front piston 5108 biasing the poppet assembly to close. A variable hydrostatic absolute pressure force $F_{flow}$ derived from the seawater hydrostatic pressure with dynamic pressure loss due to flow through the flow body 5150 is applied to the poppet assembly 5105.

The force balance equation is $(F_{end}+F_{acc})*\text{Bias}-F_{int}-F_{flow}=0$. Where the resultant force of $F_{end}+F_{acc}$ represents the delivery pressure in absolute pressure (gage+hydrostatic), a decrease in $F_{int}$ will cause the poppet assembly 5105 to open and begin flowing until $F_{int}$ increases to close the poppet assembly 5105. During flow through the flow body 5150, a decrease in the apparent hydrostatic pressure is observed causing a reduction in $F_{flow}$ causing a further bias to open the poppet assembly 5105 further. As flow through the flow body 5150 is a consequence of delivery fluid demand on the intensifier 1000 on feedback line 1905 causing $F_{int}$ to reduce, as the intensifier catches up with flow demand, $F_{int}$ will increase and bias the poppet assembly 5105 to close; further reducing flow through the flow body 5150, consequently reducing the hydrodynamic reduction of $F_{flow}$, further biasing the poppet assembly to close. In order to bias the regulator to maintain a constant closing pressure, $F_{acc}$ is decreased by reducing the pilot accumulator 3200 pressure below the desired gage pressure of the intensifier delivery fluid and output 1900 header.

Figure 16:
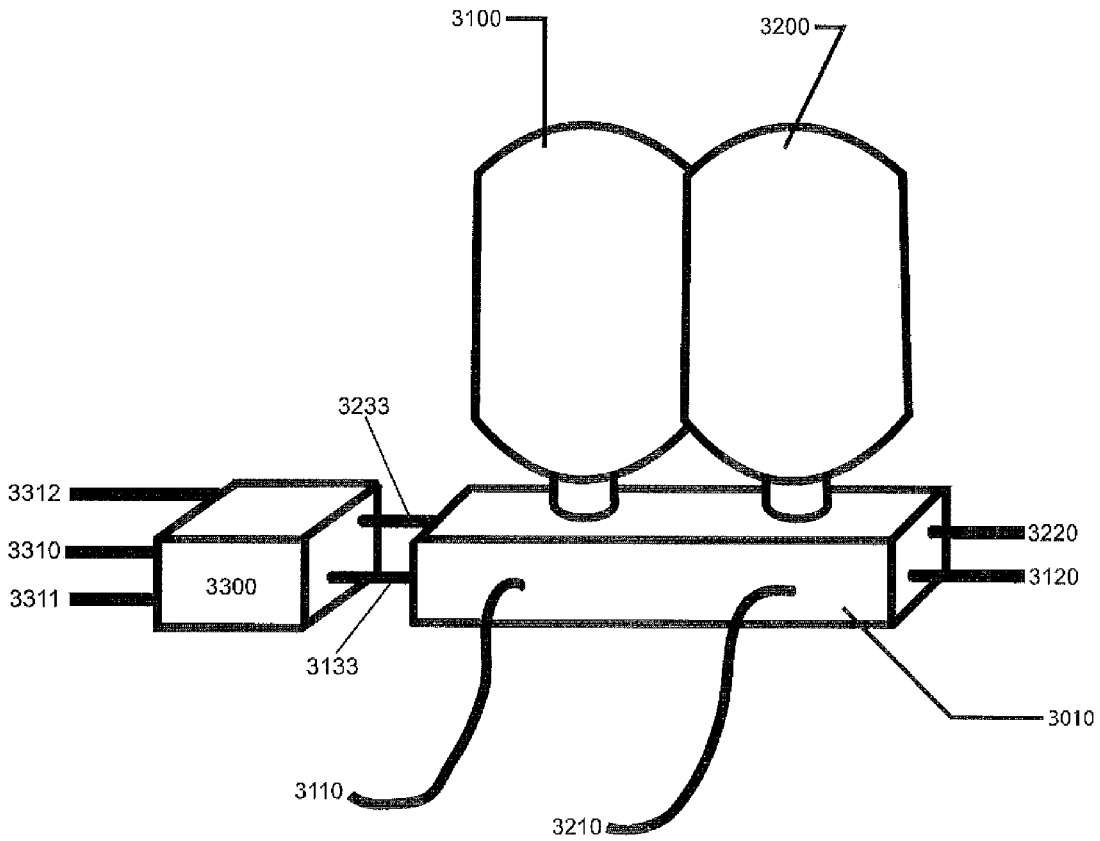
FIG. 16 is a reference assembly.

FIG. 16 illustrates the assembly of the reference pump module 3300 and reference reservoir 3100 and pilot accumulator 3200 in reference assembly 3000. The pilot accumulator 3200, reference reservoir 3100, reservoir pressure transmitter 3121, and pilot accumulator pressure transmitter 3221 are mounted into a manifold block with internal porting to connect to pilot accumulator reference tubing 3220, reservoir circulation tubing 3120, reference pump reservoir tubing 3133, and reference pump accumulator tubing 3233. The reference pump double acting pump module 3520; check valves 3530, 3531, 3532, 3533; and subplate mounted 3-way valve 3510 are mounted into a manifold block with internal porting between the mounted components and connections to reference pump reservoir tubing 3133, reference pump accumulator tubing 3233, reference pump stroke pilot tubing 3310, reference pump stroke pilot tubing 3311, and pilot accumulator increase/decrease selector pilot tubing 3312

Figure 17:
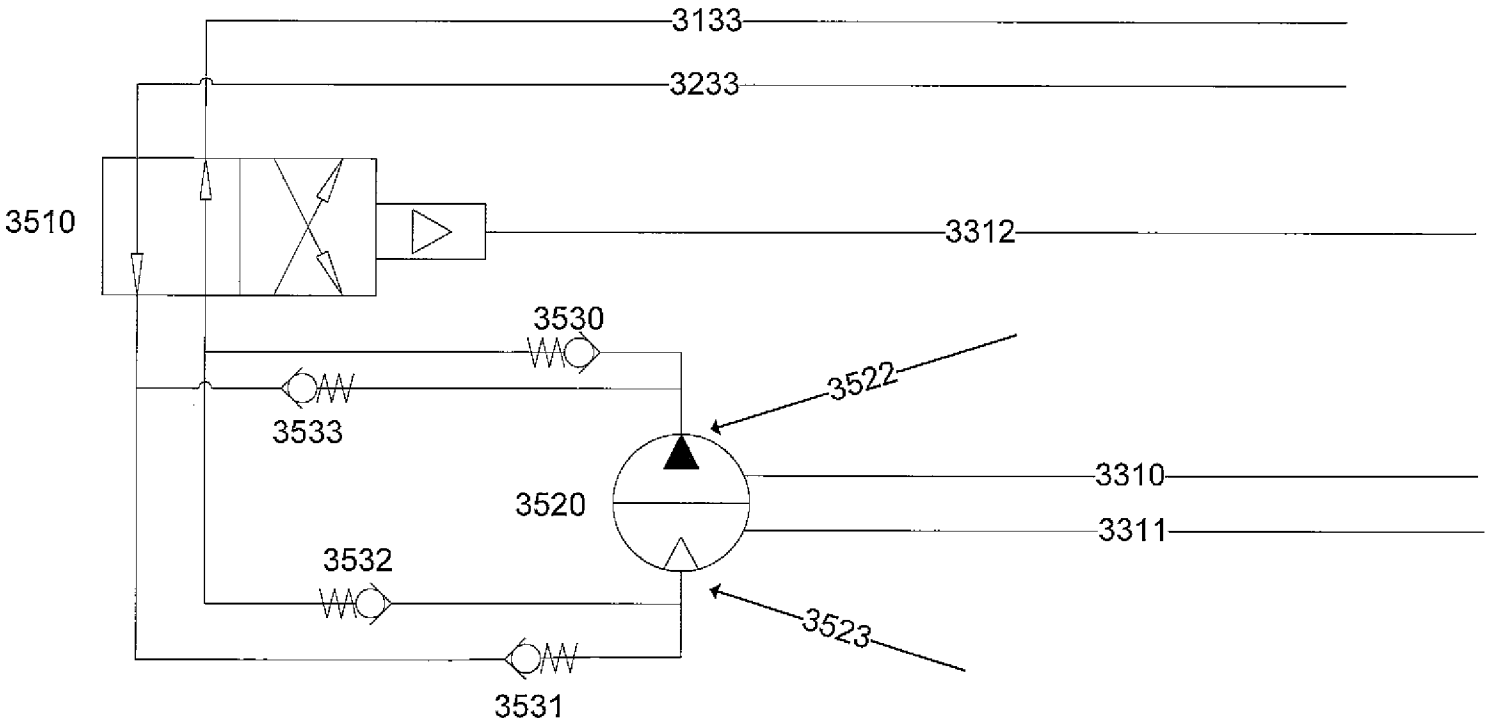
FIG. 17 is a schematic of a reference pump.

FIG. 17 illustrates the schematic of the reference pump module where pilot signals 3310 and 3311 cause a double acting axial pump 3520 to back and forth as the respective pilot signals 3310 and 3311 are pressurized and vented in a mutually exclusive manner (e.g. both pilots are not energized at the same time). The check valves cause fluid to be moved through the 3-way valve 3510 resulting in moving fluid between 3133 and 3233. The direction of movement is governed by the pilot signal 3312 acting on the 3-way valve 3510.

Figure 18:
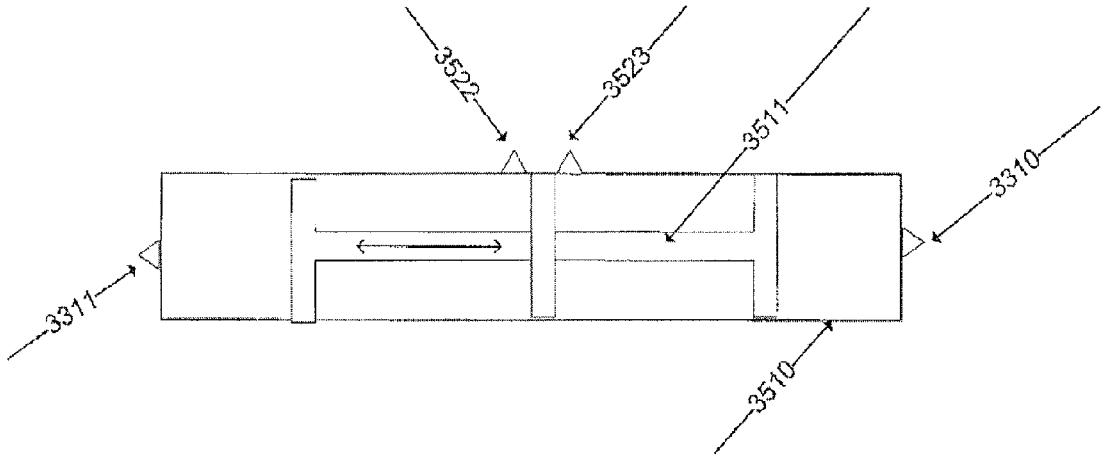
FIG. 18 is a schematic of a reference pump module.

FIG. 18 shows the action of pump 3520. As hydraulic pilots 3310 and 3311 move the center piston in each direction, fluid at ports 3522 and 3523 is displaced in and out of the center chambers. The differential area between the piston 3511 rod end and piston end results in an intensification of pressure between that exerted at 3310 and an resultant at 3523, allowing the pump to generate a pressure in excess of the piloting pressure. The swept volume of the pump is approximately 0.25 cubic inches per stroke, allowing pilot accumulator pressure to be adjusted in small increments.

Figure 19:
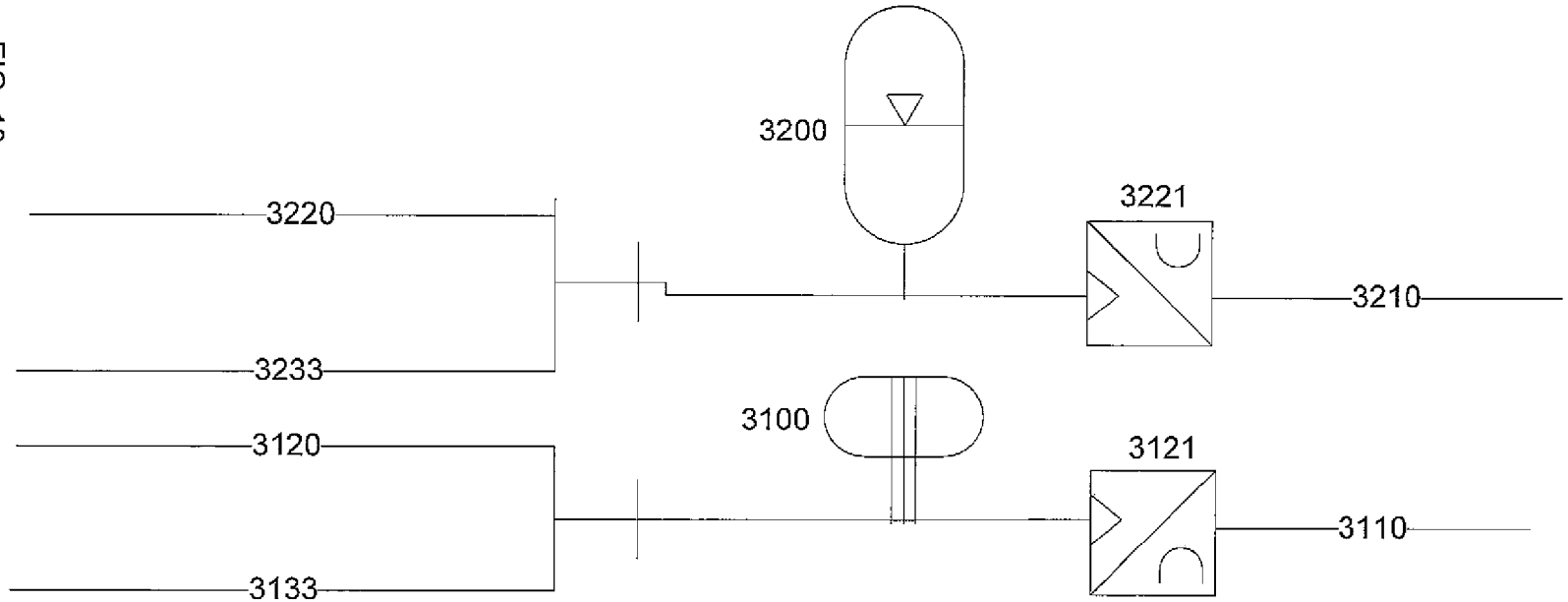
FIG. 19 is a schematic of a reference pilot accumulator and reservoir.

FIG. 19 illustrates the schematic of the reference reservoir 3100 and pilot accumulator 3200. The pilot accumulator 3200 provides a gage pressure reference (relative to the reference reservoir 3100 absolute pressure (one atmosphere)) for the regulator 5000. The reservoir gross volume is a function of the accumulator net volume. The pressure transducers allow monitoring of the respective reservoir pressures for diagnostic purposes. A maximum of 2.5 gallons gross accumulator volume can satisfy regulator 5000 operation. The reference assembly 3000 is a closed system and does not discharge hydraulic fluid from the reservoir or pilot accumulator.

As fluid is pumped into the pilot accumulator 3200 from the reference reservoir 3100, the precharge gas in the pilot accumulator 3200 is compressed and its hydraulic pressure increases. As fluid is pumped from the pilot accumulator 3200 to the reference reservoir 3100, the gas expands and the accumulator hydraulic pressure decreases. The use of incremental increase and decrease of pilot accumulator 3200 pressure allows intensifier 1000 pressure delivery 1900 to be increased or decreased in a controlled manner without violent swings. The precharge pressure of the gas when the pilot accumulator 3200 is near half capacity, establishes it's median. The range of pressure adjustment is a function of the gross volume of the pilot accumulator 3200. The gross volume of the reference reservoir 3100 is a function of the gross volume of the pilot accumulator 3200.

Figure 20:
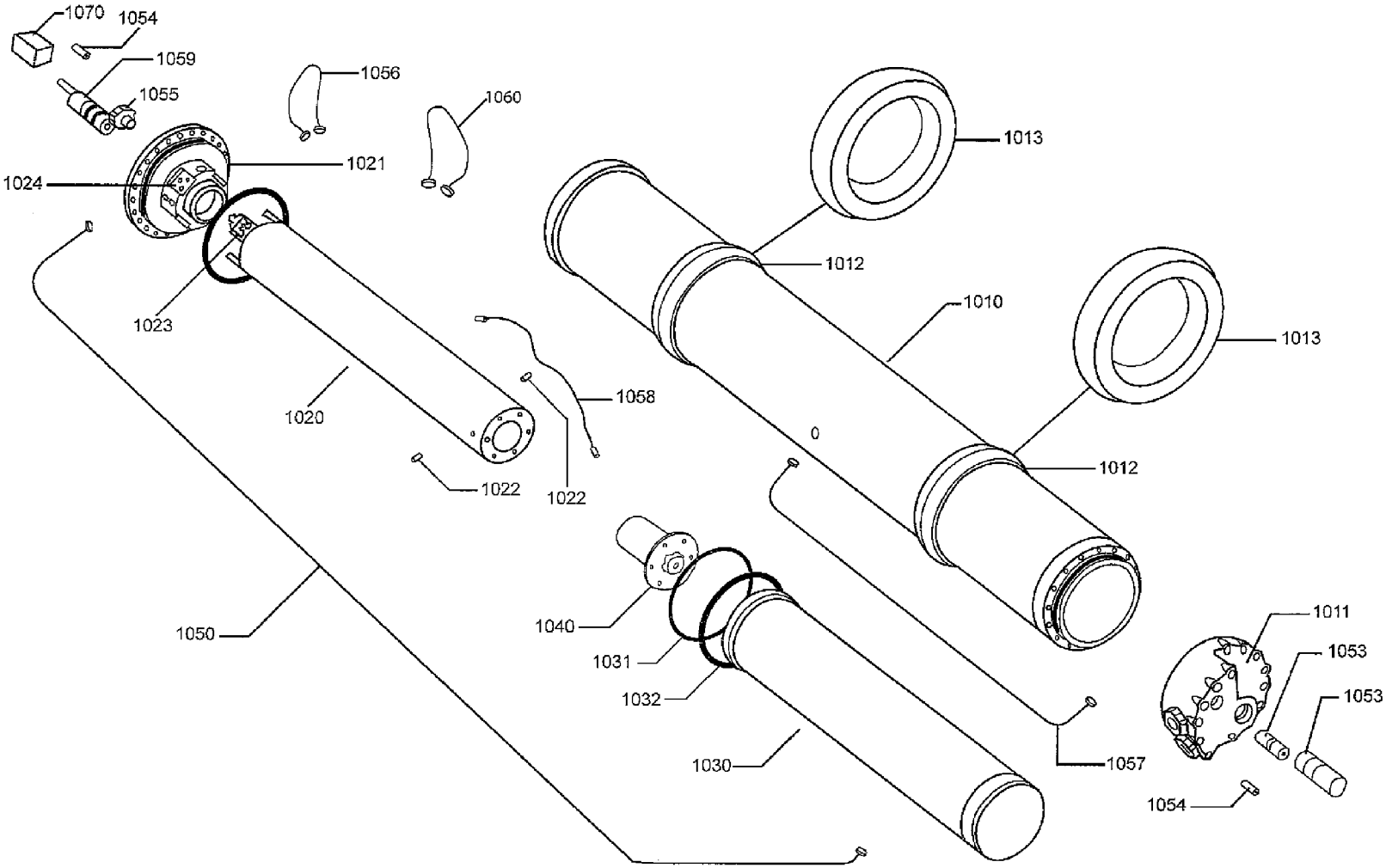
FIG. 20 is an exploded view of an intensifier.

FIG. 20 illustrates an exploded view of the intensifier 1000. The intensifier 1000 is comprised of an outer barrel 1010, elastomer mounting rings 1013, an inner barrel 1020, an inner barrel instrument package 1040, an inner barrel instrument jumper 1058, two inner barrel proximity sensors 1022, a piston 1030, a piston inner diameter seal 1031, a piston outer diameter seal 1032, an upper outer barrel flange 1011, a regulator isolation valve 1053, a pump isolation valve 1053, a regulator pressure transducer 1054, a lower outer barrel flange 1021, a delivery pressure transducer 1054, a instrumentation and power connector 1055, a delivery pressure transducer instrument jumper 1056, a regulator pressure instrument jumper 1050, and a pump recharge tubing jumper 1057. The inner barrel 1020 is attached to the lower outer barrel flange by means of a locking breach 1023. The outer barrel flanges 1021 and 1011 are attached to the top and bottom of the outer barrel 1010. The lower outer barrel flange 1021 incorporates a dry-mate subsea bulkhead connector 1055 to provide connection between the inner barrel instrumentation package and the intensifier junction box 1070. The upper outer barrel flange 1011 incorporates subplate mounted piloted control valves 1053 for isolation of the seawater section of the intensifier 1000 from the regulator 5000 and the recharge pump 6000. A subplate mounted pressure transducer 1054 is mounted to the upper outer barrel flange 1011 to provide pressure measurement of the internal seawater pressure in the intensifier 1000. The lower outer barrel flange 1021 incorporates a subplate mounted control valve 1051 for isolating the delivery fluid section of the intensifier 1000 from the delivery fluid output and fill header. An alternative subplate mounted control valve 1059 may be substituted to allow the intensifier 1000 to be filled from either fluid delivery output and fill header 1900 or from an external fluid recovery reservoir 1901. A subplate mounted pressure transducer 1054 is mounted to the lower outer barrel flange 1021. The subplate mounted pressure transducers incorporate dry mate connectors, allowing the use of pressure balanced oil filled (PBOF) cables 1056 and 1050 to be interconnected to the intensifier junction box 1070 near the bottom of the intensifier 1000. The instrument junction box 1070 is comprised of pressure housing with dry mate connections for; the seawater pressure instrument PBOF cable 1058, the delivery fluid supply pressure instrument PBOF cable 1050, the intensifier bulkhead PBOF cable 1060, and the external underwater control system intensifier PBOF cable 1910. The intensifier bulkhead PBOF cable is comprised of a multiconductor (copper) cable supporting separate conductors for 24 volt DC power and serial communications from the external underwater control system to the inner barrel communications port module 1120. The external underwater control system intensifier PBOF cable 1910 is comprised of a multiconductor (copper and fiberoptic) cable supporting separate conductors for 24 volt DC power, fiber optic signal lines, and serial communications to the external underwater control system.

The geometry of the piston 1030 allows for a seawater annulus between the outer piston 1030 wall above the seal locations of the piston 1030, and the inner diameter of the outer barrel above the highest position the seals may reach (inches above the seal location with the piston in its highest position). An extraction port 1060 and washout port 1060 are located slightly above these levels to allow the annular volume exposed to seawater to be evacuated or cleaned. The extraction port 1060 and annulus longitudinal cross-sectional area are sized to ensure turbulent flow is realized across the outer piston 1030 walls when seawater is pumped from the recharge port at low extraction flow rates. The turbulent flow provides for a self-cleaning action to the seawater interior of the intensifier 1000 when it is being recharged for subsequent operation.

Piston 1030 position is measured within the one-atmosphere conjoined chamber of the inner barrel 1020 and piston 1030 to derive remaining hydraulic volume of the hydraulic annulus. Piston 1030 position is measured relative to the inner barrel instrumentation package 1040. Piston 1030 position at the full and empty position is measured by inductive proximity sensors 1022. No sensor for measuring piston 1030 position crosses a pressure boundary, in contrast to prior art intensifier instrumentation. Fluid level in the inner barrel 1020 (as a consequence of unintended leakage across dynamic Piston seals) is measured relative to the inner barrel instrumentation package 1040.

Figure 21:
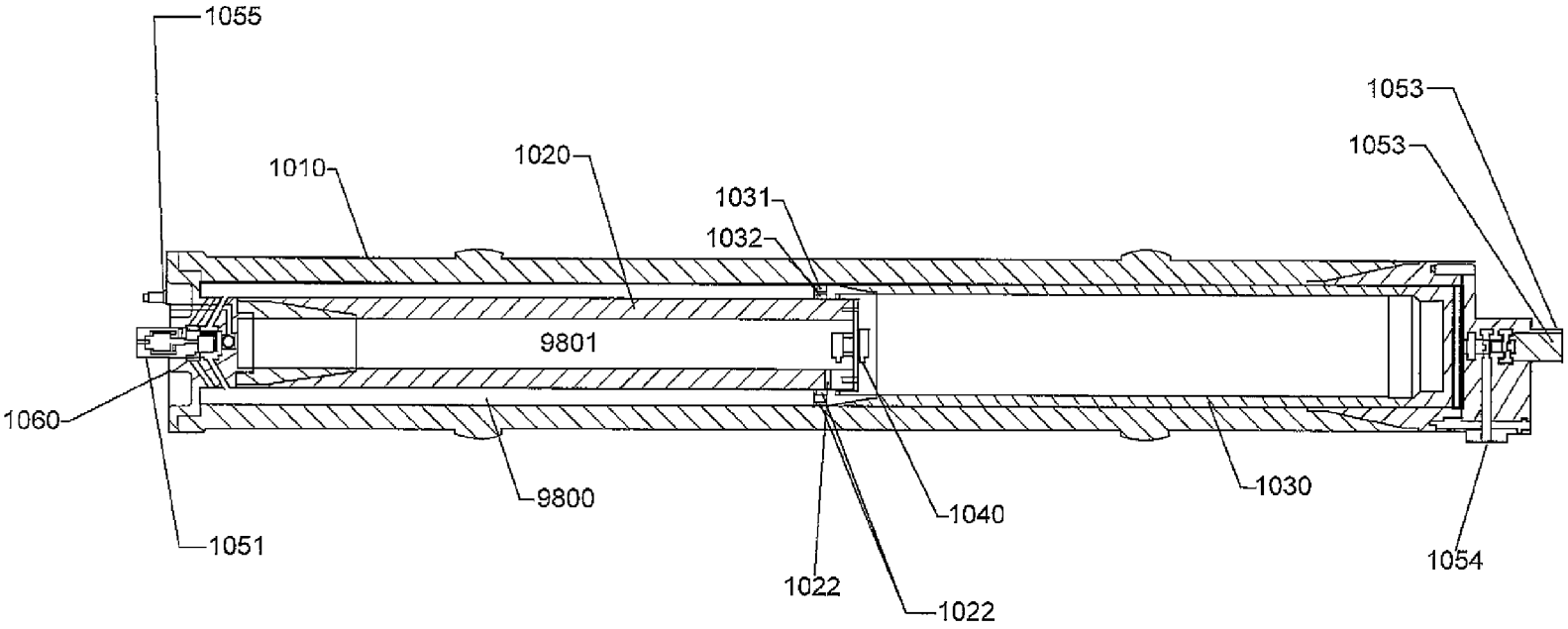
FIG. 21 is a cross section view of an intensifier.

FIG. 21 illustrates the cross section view of the intensifier 1000 showing the piston 1030 in a fully retracted state, full of delivery fluid in 9800. The intensifier 1000 is an annular piston pressure intensifier axial pump, which provides for pressure multiplication between the seawater supply side of the pump 1054 and the fluid delivery volume 9800.

Figure 22:
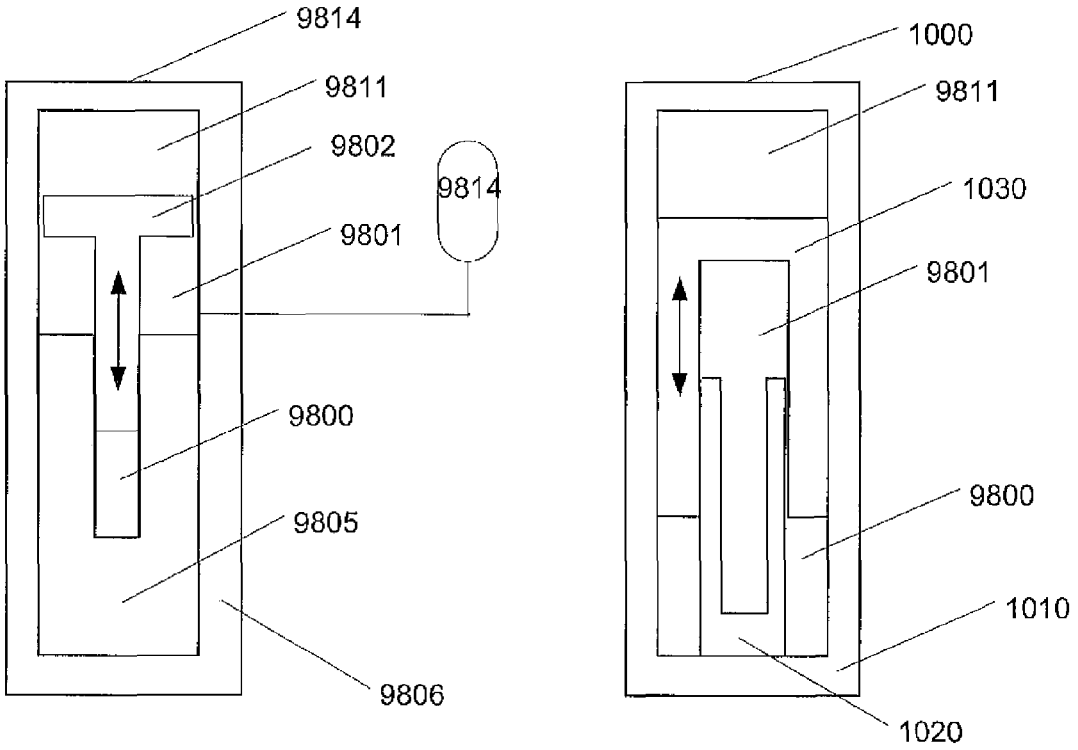
FIG. 22 is a comparison of intensifying cylinders.

FIG. 22 illustrates a comparison of pressure intensifiers, intensifier 9814 and intensifier 1000 embodied in this apparatus. Intensifier 9814 uses a rod and piston arrangement 9802 which requires an annular volume 9801 between the piston and rod seal which must be vented to ambient pressure, otherwise leakage into this volume 9801 will cause the intensifier to hydraulically lock in place. Intensifier 9814 used for the generation of hydraulic power require the use of external one-atmosphere chambers 9814 to provide the vent required.

The intensifier 1000 of this embodiment uses a rod-less piston design utilizing dynamic seals on the inner and outer diameter of the piston 1030 skirt to provide the intensification area of the delivery fluid supply side 9800 of the intensifier 1000 relative to the piston 1030 head area. The piston skirt/seal travels between the outer barrel 1010 and inner barrel 1030 and over the inner barrel 1030 to define the hydraulic annular volume 9800 in which delivery fluid is pressurized.

The internal volume of the inner barrel 1020 and the piston 1030 provide a conjoined volume 9801 that increases and decreases as the piston 1030 moves up and down the outer barrel 1010. This conjoined volume is a significant multiple of the hydraulic delivery volume, as opposed to a fraction of the volume seen in prior art intensifiers 9814, and does not require the use of an external accumulator 9814. Due to the configuration of this rod-less design, the volume of 9814 is utilized to incorporate position sensing instrumentation to measure piston 1030 elevation to derive volumetric measurement of 9800 without requiring the use of sensors operating at pressure within either 9811, 9800, or ambient hydrostatic pressures.

Figure 23:
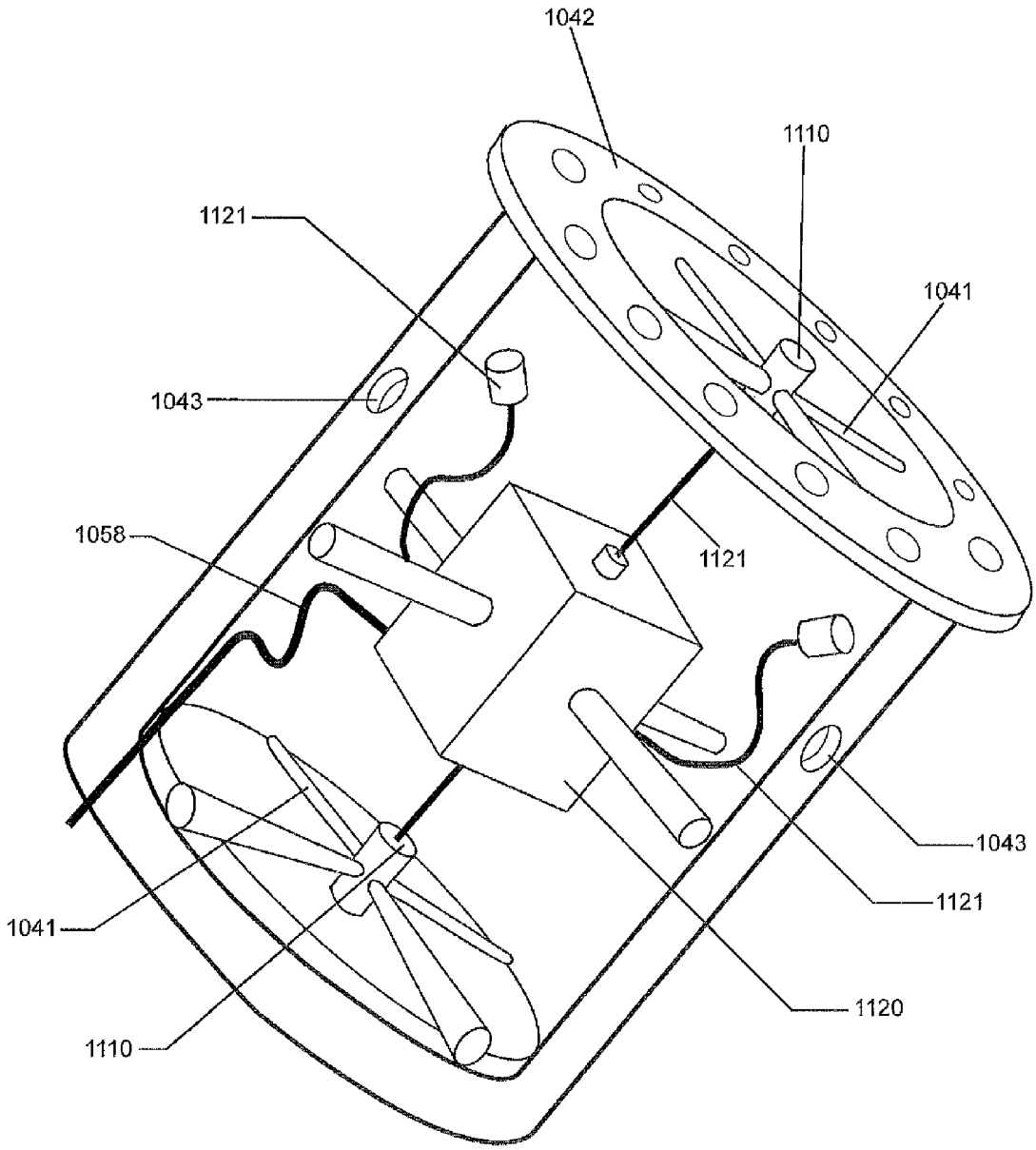
FIG. 23 is a cross section view of an inner barrel instrument package.

FIG. 23 illustrates a cross section view of the inner barrel instrument package 1040. The package 1040 is comprised of a cage 1042 containing a piston position sensor 1010, fluid level sensor 1110, cable and connector 1121 to the inner barrel 1020 piston down position proximity sensor 1022, connector cable 1121 to the inner barrel 1020 piston up position proximity sensor 1022, intensifier remote input/output computer node 1120. The cage 1042 is secured to the top of the inner barrel 1020. The inner barrel package 1042 is connected to the lower intensifier barrel flange bulkhead connector 1055, via the inner barrel instrumentation cable 1058. The interconnection cable 1055 is routed along the inside wall of the inner barrel 1020 to allow sensor 1110 visibility of the bottom for purposes of fluid incursion detection and measurement.

Figure 24:
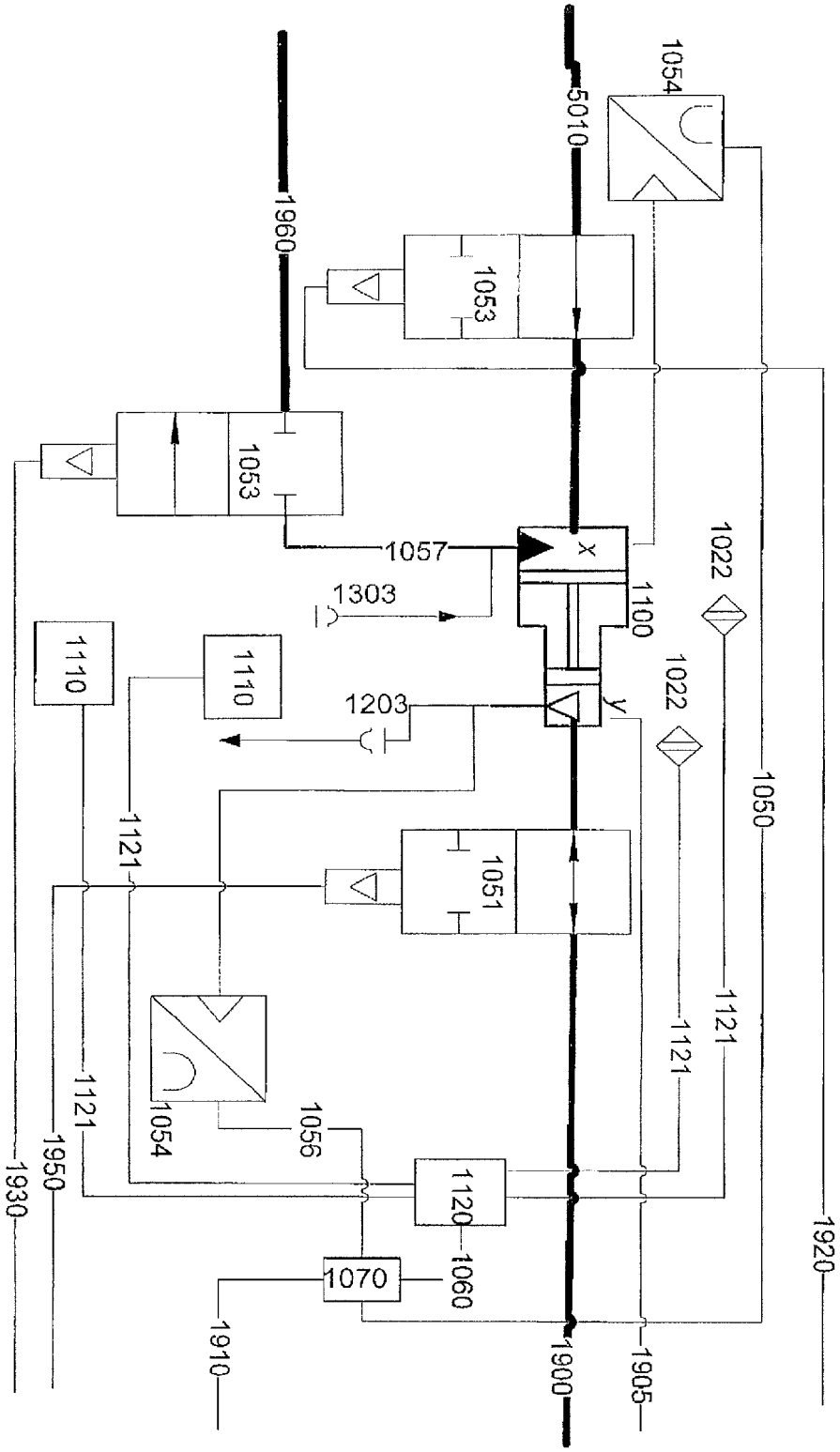
FIG. 24 is a schematic of an intensifier without fluid recovery.

FIG. 24 illustrates the schematic view of the intensifier without the option of recharge from an external fluid recovery tank.

Figure 25:
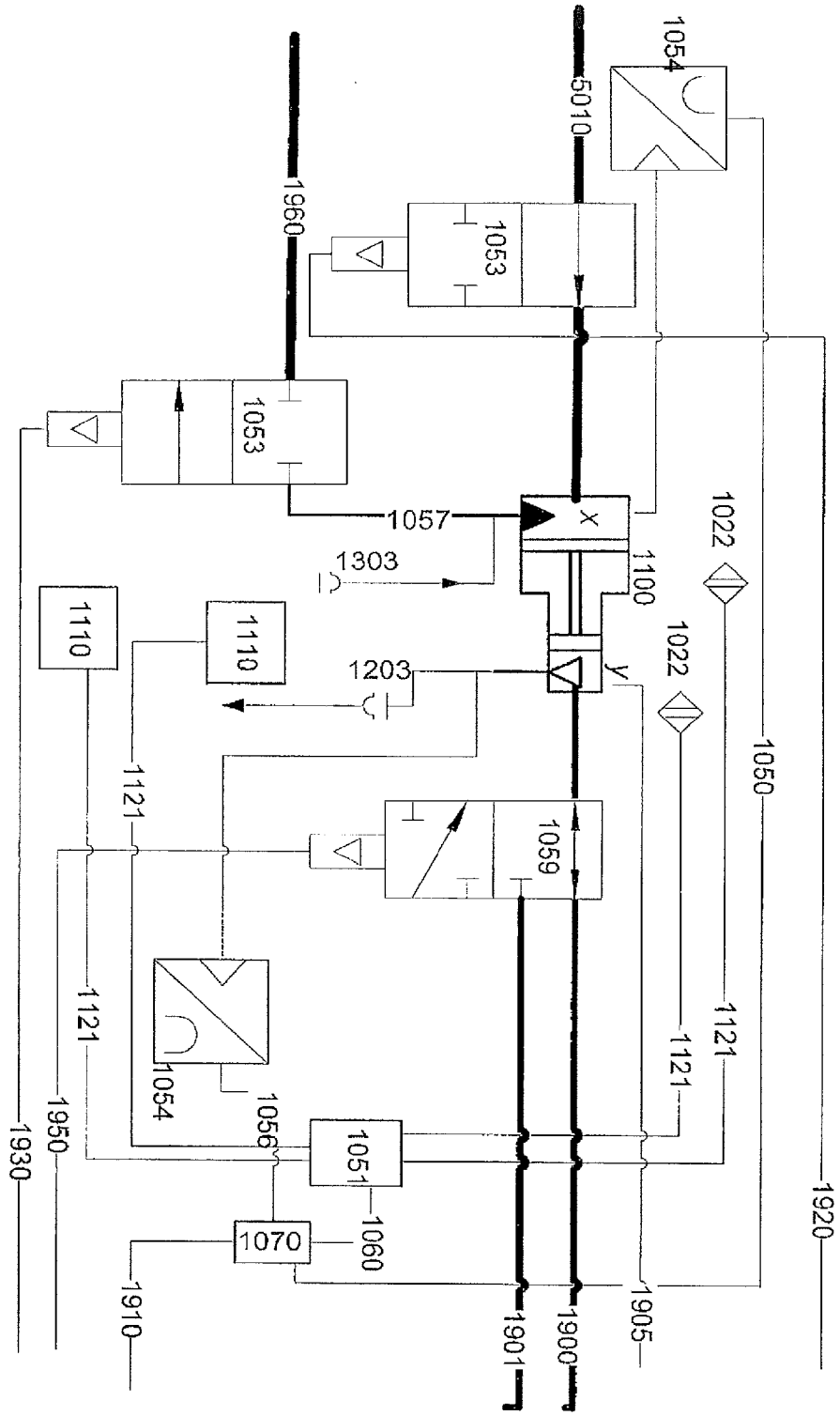
FIG. 25 is a schematic of an intensifier with fluid recovery.

FIG. 25 illustrates the schematic view of the intensifier with the option of recharge from an external fluid recovery tank via 1910.

Figure 26:
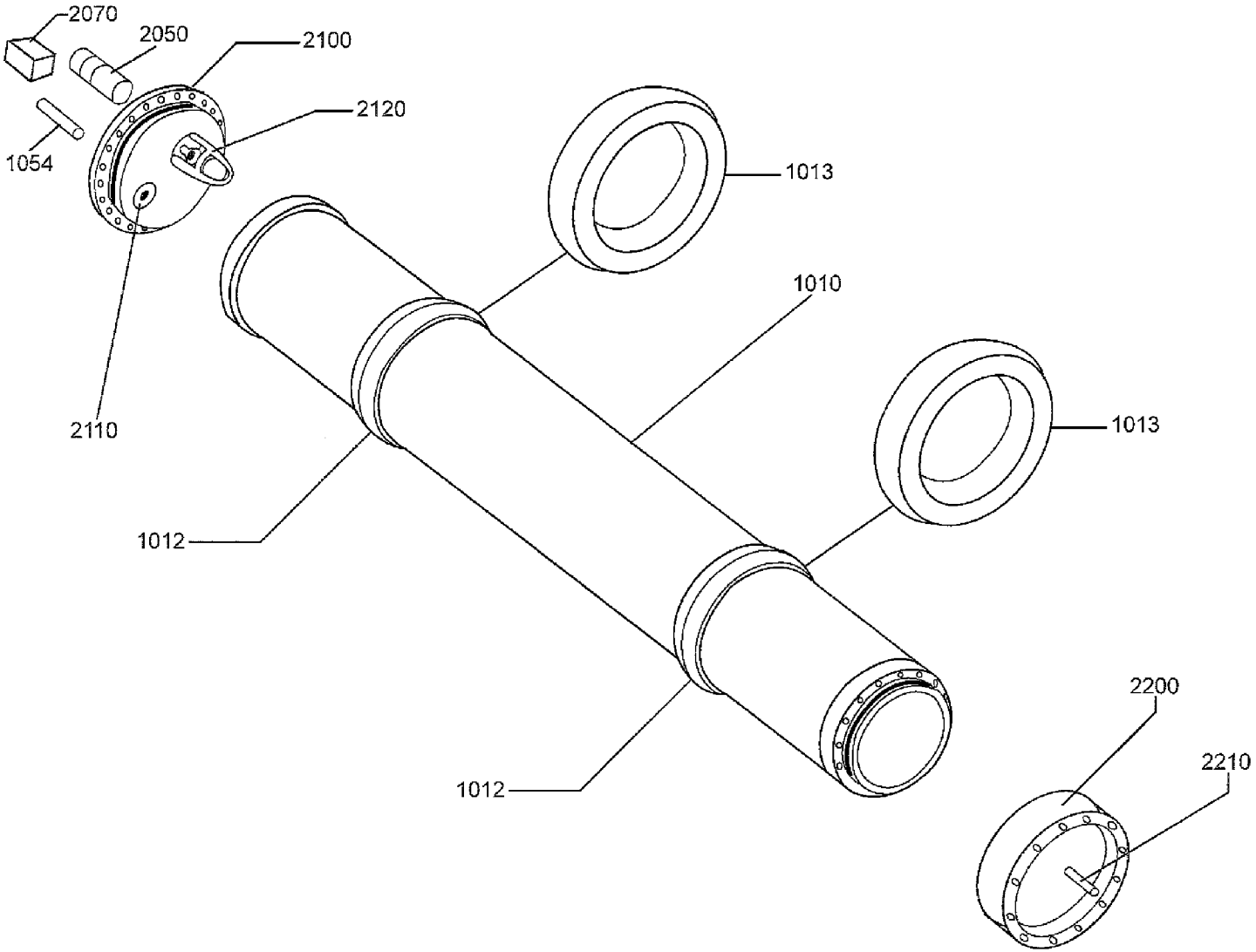
FIG. 26 is an exploded view of an accumulator.

FIG. 26 illustrates and exploded view of the accumulator 2000. The accumulator 2000 is comprised of the same outer barrel 1010 as used in the intensifier 1000, two elastomer mounting rings 1013, an upper outer barrel flange 2200, a lower outer barrel flange 2100, a delivery pressure transducer 1054, a delivery pressure transducer instrument jumper 1056, a liquid level sensor 2110, an accumulator junction box 2070, and a caged poppet valve 2120. The outer barrel flanges 2200 and 2100 are attached to the top and bottom of the outer barrel 1010. The lower outer barrel flange 2100 incorporates a subplate mounted control valve 2050 for isolating the delivery fluid section of the accumulator 2000 from the delivery fluid output and fill header. A subplate mounted pressure transducer 1054 is mounted to the lower outer barrel flange 2100. The subplate mounted pressure transducers incorporate dry mate connectors, allowing the use of pressure balanced oil filled (PBOF) cables 1056 and 1050 to be interconnected to the accumulator junction box 2070 near the bottom of the accumulator 2000. The accumulator junction box 2070 is comprised of pressure housing with dry mate connections for the delivery fluid supply pressure instrument PBOF cable 2061, the accumulator liquid level sensor PBOF cable 2062, and the external underwater control system PBOF cable 1910. The external underwater control system intensifier PBOF cable 1910 is comprised of a multiconductor (copper and fiberoptic) cable supporting separate conductors for 24 volt DC power, fiber optic signal lines, and serial communications to the external underwater control system. The upper outer barrel flange 2200 incorporates a gas charge valve 2210 to allow the accumulator to be precharged with nitrogen at a pressure appropriate to the deployment depth required.

Figure 27:
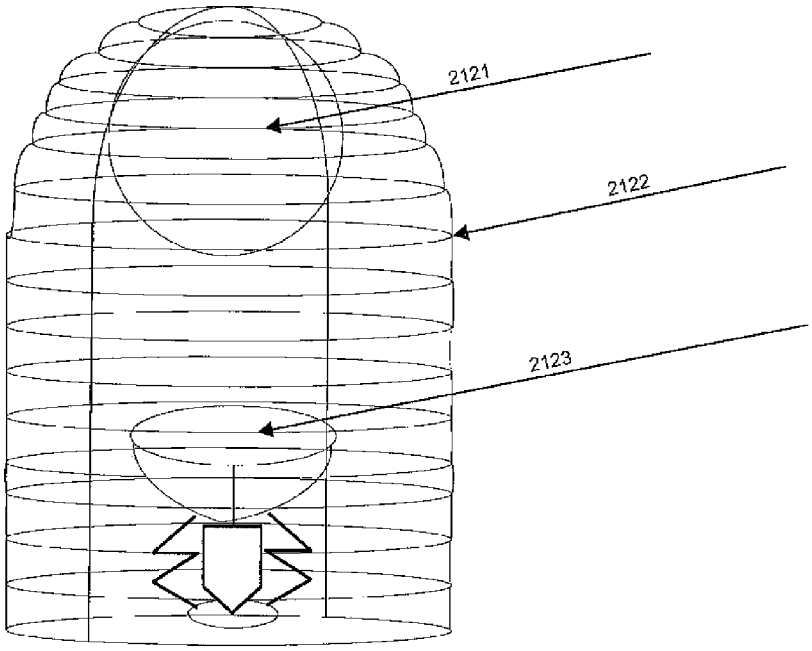
FIG. 27 is a caged float valve arrangement.

FIG. 27 illustrates the caged float valve 2120 used in the accumulator to isolate the delivery fluid output and prevent loss of precharge gas at low liquid levels. The poppet valve 2123 is spring loaded to open without the weight of the float 2121. When the liquid level rises, the float 2121 rises and allows the poppet valve to open. Use of the cage 2122, allows the use of this assembly 2120 without the need for mechanical interconnections between the caged float valve 2120 and the upper outer barrel flange 2200.

Figure 28:
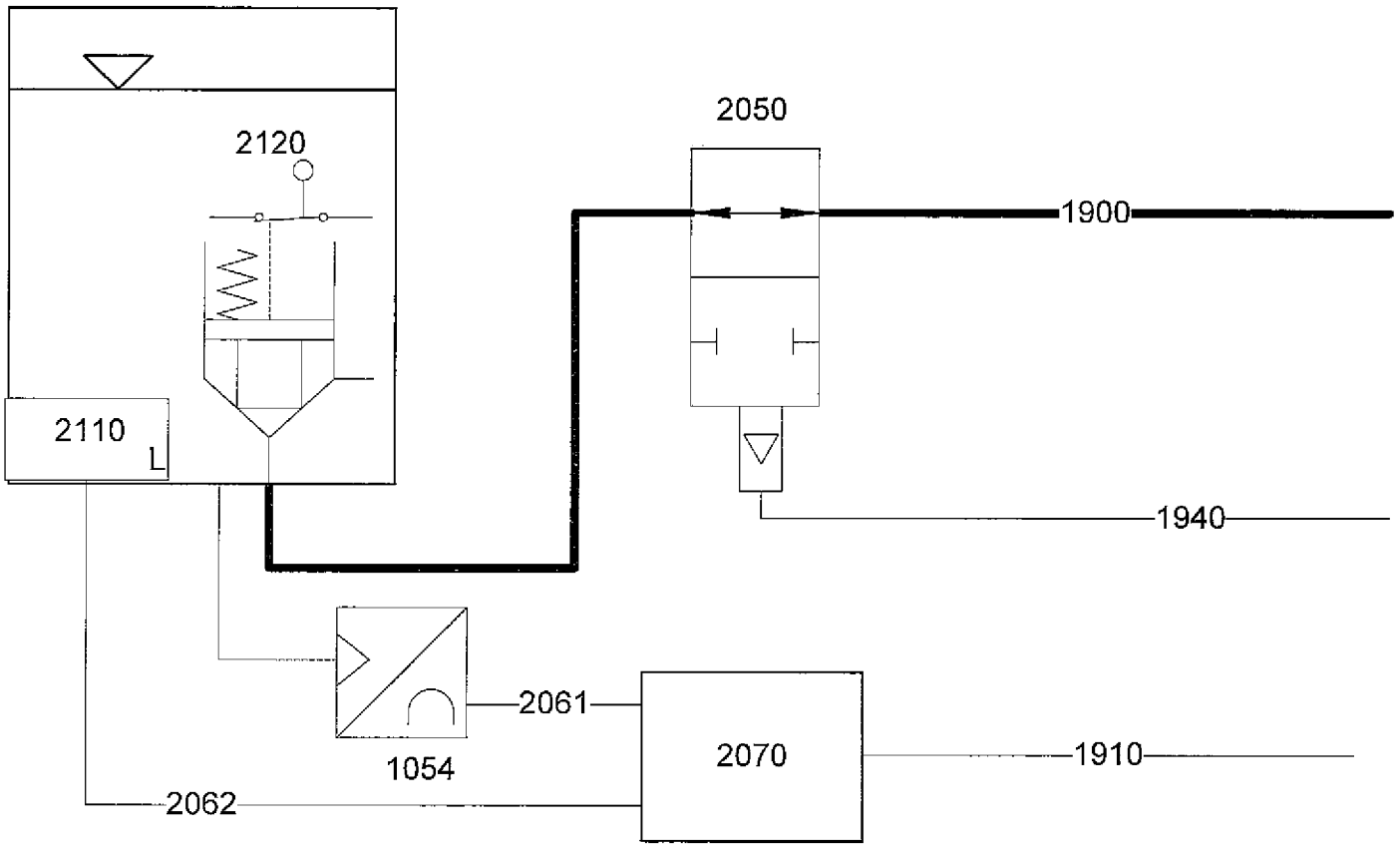
FIG. 28 is a schematic of an accumulator.

FIG. 28 illustrates the arrangement of the liquid level sensor 2110, pressure transducer 1054, caged poppet valve 2120, and accumulator isolation valve 2050. Accumulator junction box 2070 allows interconnection of the accumulator 2000 instrumentation to the external underwater control system via 1910, allowing for consistency of mechanical interface between use of accumulator 2000 and intensifier 1000. The liquid level sensor 2110 utilizes a time-of-flight acoustic ranging technique to measure the distance to the liquid free surface in the accumulator. On discharge and recharging of the accumulator 2000, the delivery fluid may develop foam or froth at the free surface. Ranging upward to the free surface allows an accurate measurement of distance sufficient to derive useable fluid volume in the accumulator.

Figure 29:
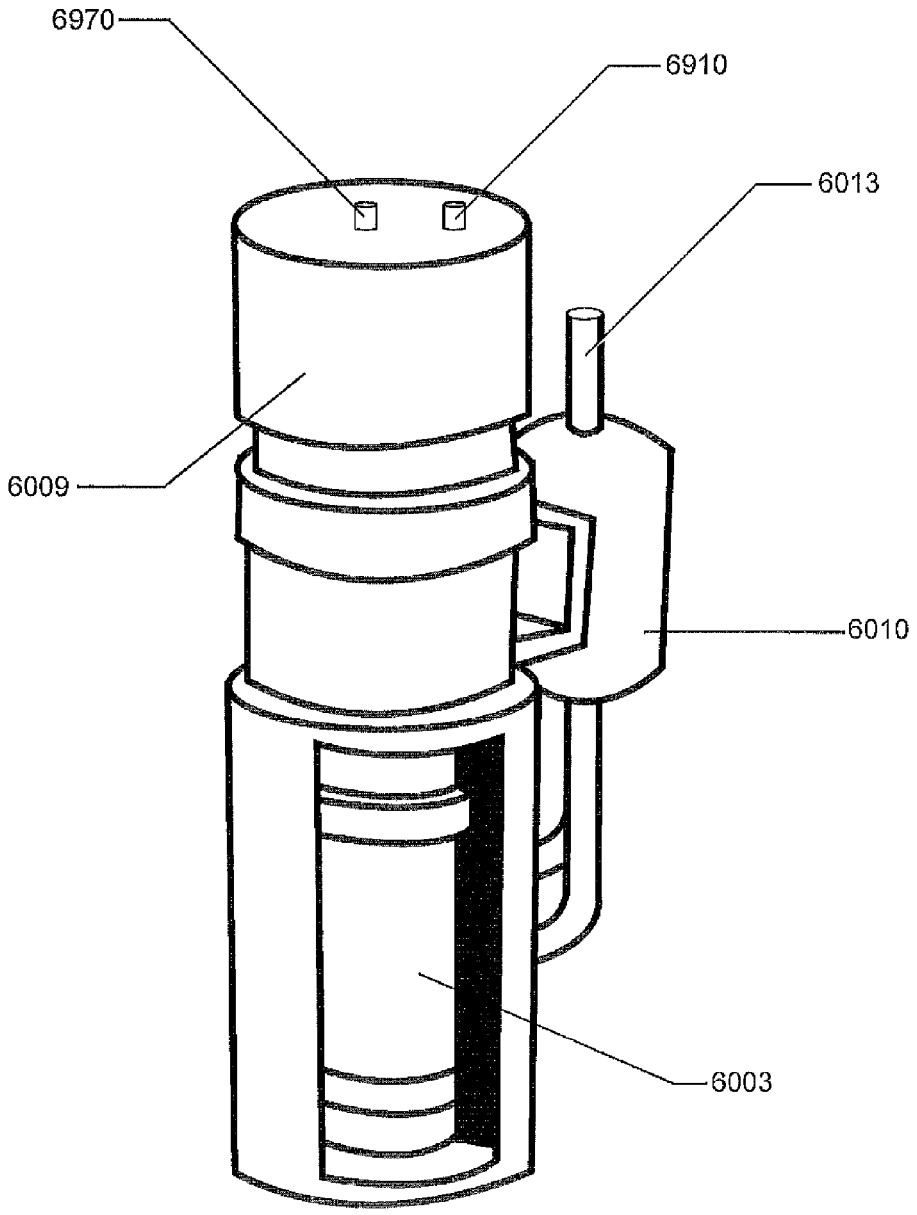
FIG. 29 is a recharge pump assembly.

FIG. 29 illustrates the recharge pump 6000 assembly. The recharge pump 6000 is comprised of an electric motor and drive unit 6030, a positive displacement pump 6003 that exhausts to ambient seawater, a pressure compensation assembly 6010 with sea water inlet 6960, a dry-mate underwater electrical power connector 6971, and a dry mate underwater instrument power and communications connector 6911. The recharge pump 6000 allows seawater to be pumped from equipment that is at or lower than ambient seawater pressure, to exhaust the seawater at ambient seawater pressure.

Figure 30:
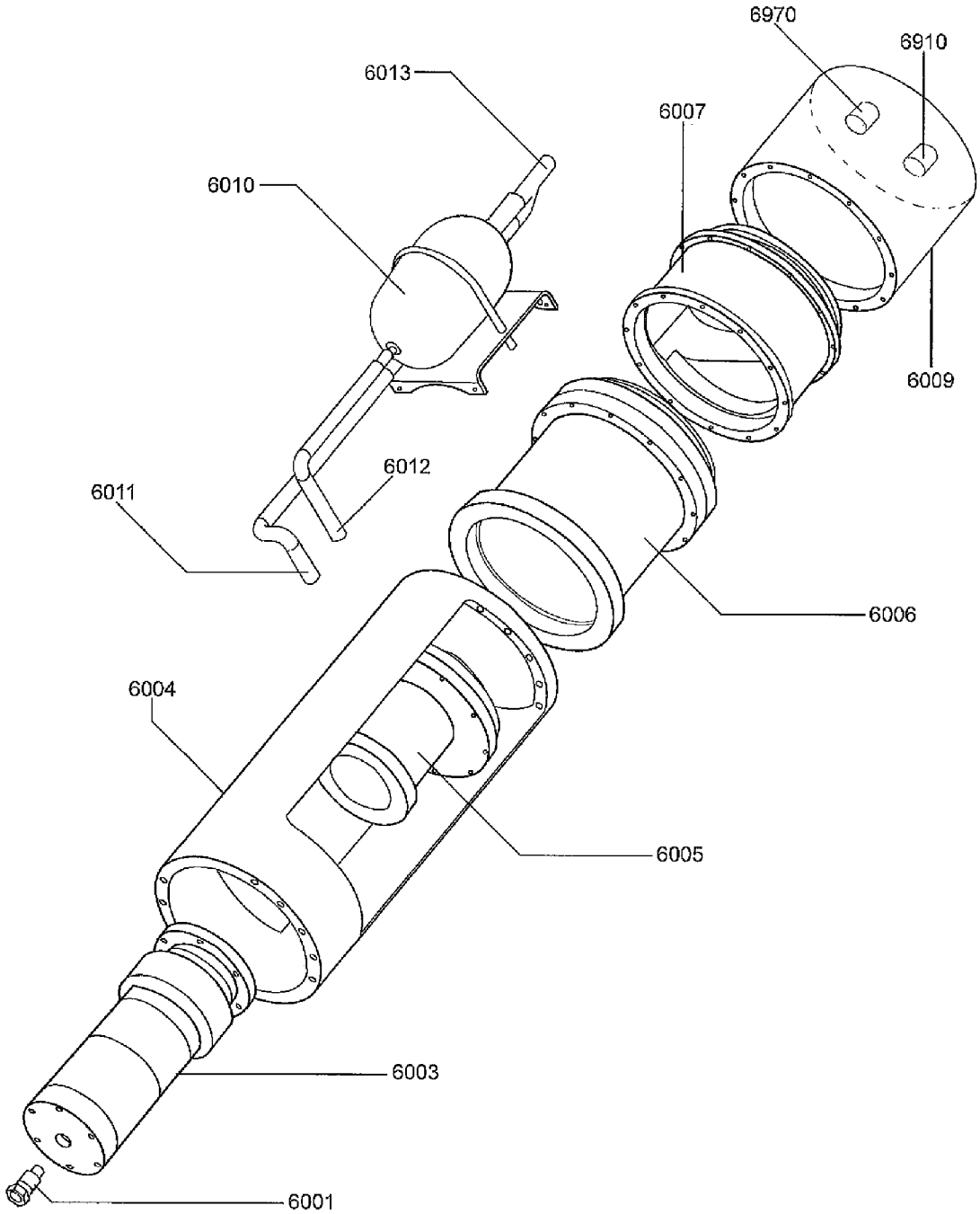
FIG. 30 is an exploded view of a recharge pump.

FIG. 30 illustrates an exploded view of the recharge pump 6000. The recharge pump 6000 comprises a seawater exhaust port 6001; seawater suction port 6013, seawater pump and housing 6003, pump shroud 6004, shaft coupler and housing 6005, lower motor housing and motor 6006, upper motor housing 6007, electronics housing 6009, and suction balance bladder 6010. The seawater suction port provides fluid communication to the seawater pump 6003 suction as well as pressure communication to the seawater pump 6003 case drain port and lower motor housing 6006. The electric motor contained in the split housing 6006 is immersed in dielectric lubricant and operates at suction pressure as communicated to the housings by port 6012. A coupling and housing 6005 mechanically connect the motor and pump through a rotating seal. The seawater pump 6003, coupler housing 6005 and motor housing 6006 and 6007 operate with a case pressure as communicated through the coupling housing 6005.

Figure 31:
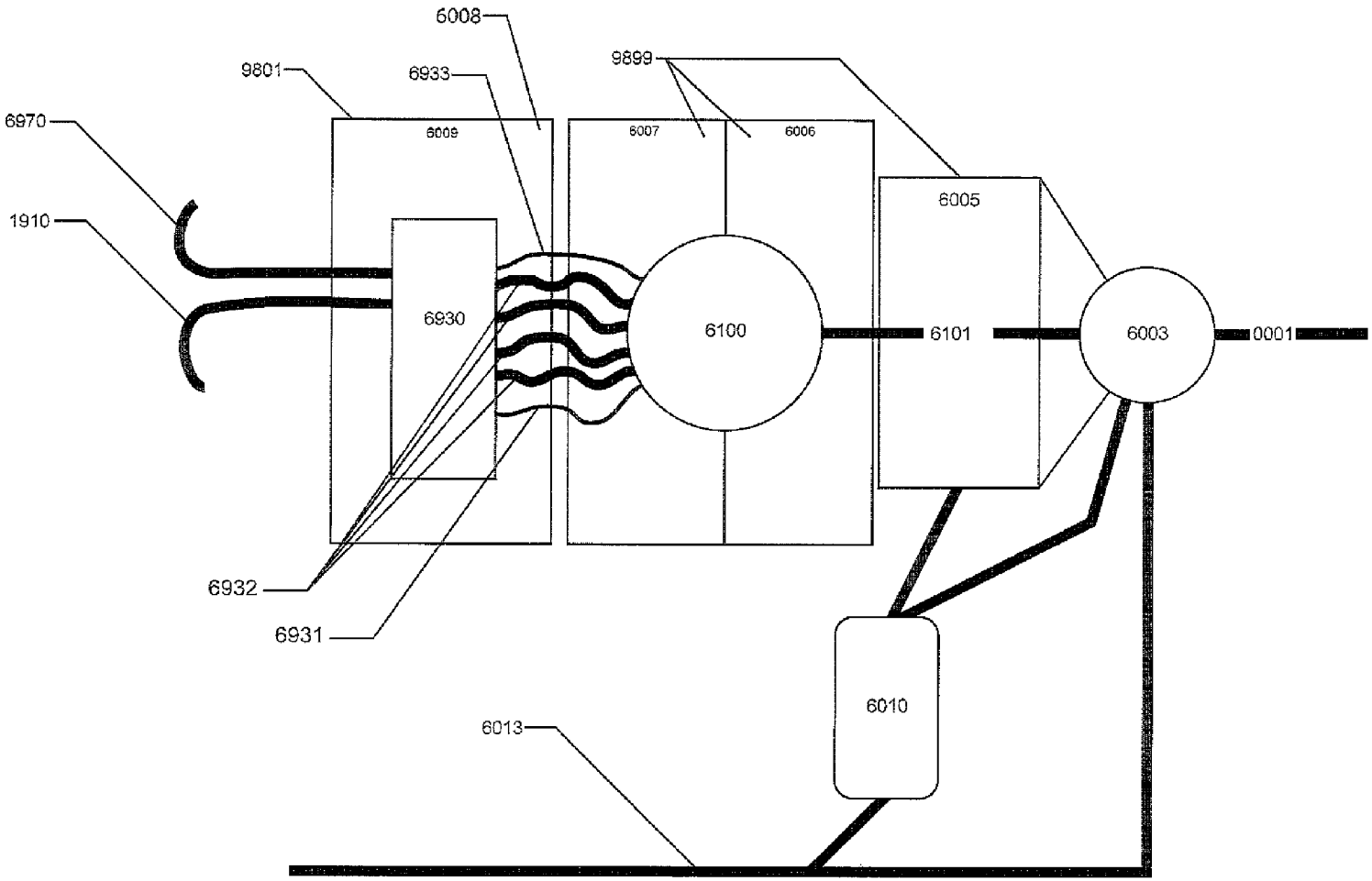
FIG. 31 is a schematic of a recharge pump.

FIG. 31 illustrates a schematic view of the recharge pump 6000. The controller/driver 6930 utilizes DC voltage 6970 to generate 3-phase stator voltage and frequency on 6932 to rotate the motor 6100 with feedback from resolver signals 6933 from the motor 6100. The motor temperature is monitored through RTD leads 6931 from the motor windings 6100. The controller/driver 6930 has the capability of controlling speed and torque developed by the motor 6100, in order to maintain a constant speed and torque with the DC voltage at nominal values. As the DC voltage 6970 level drops, the controller/driver 6930 will reduce motor speed while maintaining torque. This allows the pump 6003 to maintain operation with diminishing DC voltage while pumping seawater suction 6013 to ambient pressure 0001. The motor 6100 and pump 6003 are mechanically coupled through the coupler housing 6005 that provides a protection from seawater intrusion into the pump 6003 case and motor. Insulating dialectric fluid is used in the motor housing 6006 and 6007, as well as in the pump 6003 crankcase. The dielectric lubricating fluid is pressure compensated relative to the pump suction pressure at 6013 which is connected to the intensifier recharge connection 1057 through the compensation bladder 6010. The controller/driver 6930 is located in housing 6009 which is operated at one atmosphere pressure. The connections 6931, 6932, 6933 are connected through the intervening bulkhead between 6009 and 6007, through the use of dry-mate electrical bulkhead connectors. The controller/driver 6930 is thermally bonded to the housing 6009 wall to maximize heat transfer to the ambient seawater. The controller/driver 6930 is connected to the external underwater control system via a dry-mate bulkhead connector for 6910, and dry-mate bulkhead connector for 6970 for connection to the power pack 7000.

Figure 32:
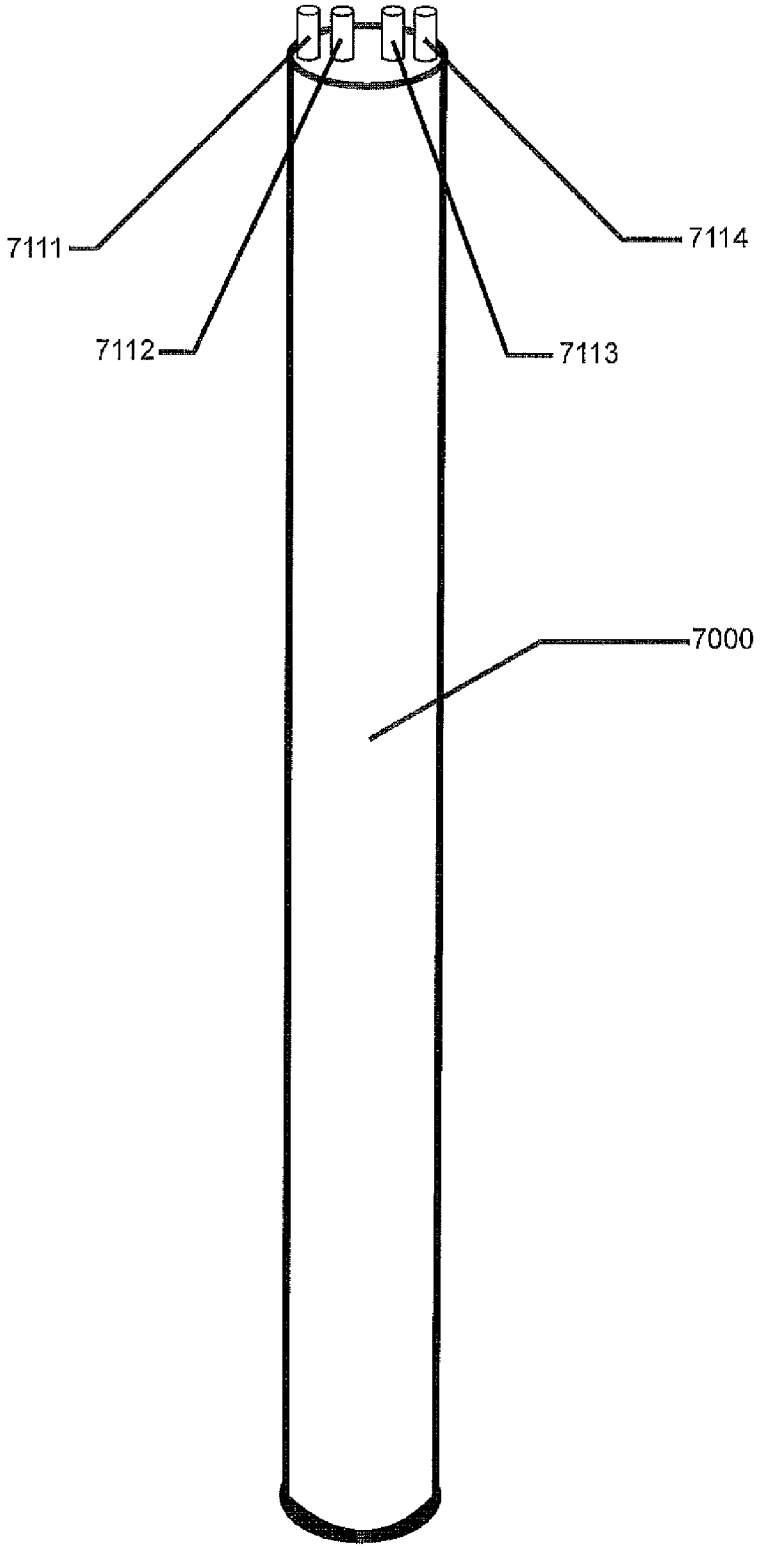
FIG. 32 is a power pack assembly.

FIG. 32 illustrates an assembly view of the power pack 7000. The power pack 7000 utilizes incoming surface supply voltage at 160-250 volts AC at a 1.6 amps to develop DC voltage for capacitive storage. The capacitive storage is maintained at a level to allow operation of the recharge pump for a limited period of time. The power pack 7000 also utilizes regenerated DC voltage from the regenerator 8000 to charge capacitive storage at a faster rate than surface supplied voltage. The power pack is monitored and controlled by an external underwater control system to allow for isolation of incoming surface supply voltage, isolation of outgoing DC voltage to the recharge pump 6000, and isolation of incoming regenerator power. The power pack 7000 incorporates an LED which allows for visual confirmation that the capacitive storage of the assembly is null and safe for removal of the upper flange. The electrical components of the power pack are housed in pressure housing with a upper flange to allow the electrical components to be removed as a complete assembly.

Figure 33:
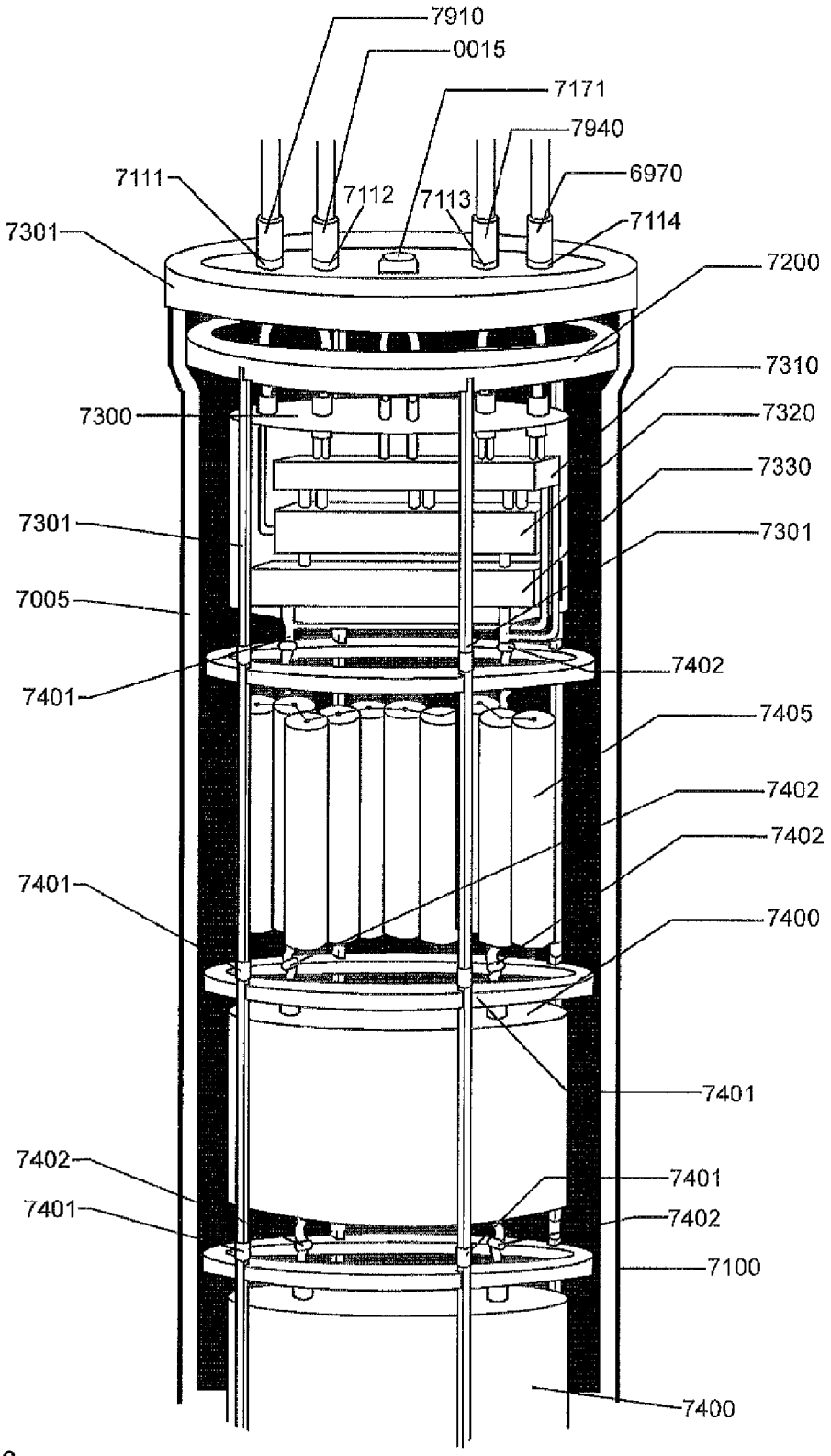
FIG. 33 is a cutaway view of a power pack assembly.

FIG. 33 illustrates a cutaway view of the power pack 7000. The power pack 7000 is comprised of a pressure housing 7005; an upper flange 7006, an instrument package hanger 7200, a power converter/relay 7300, and an array of ultracapacitor modules 7400. The upper flange is comprised of a sight glass 7113, an instrumentation power and communications connector 7111, a surface power connector 7112, a DC power input connector 7113, and a DC power output connector 7114. The power converter/relay 7300 assembly is comprised of an incoming relay module 7310, a power controller module 7330, and an outgoing relay module 7330. The power converter/relay 7300 assembly incorporates structures 7301 that mechanically fasten 7401 to the instrument package hanger 7200 and mechanically fasten to the uppermost ultracapacitor module 7400 in the ultracapacitor array. The power converter/relay 7300 incorporates a DC voltage connection (power and ground) 7402 to the uppermost ultracapacitor module 7400 in the ultracapacitor array. The power converter/relay incorporates cable connections to the upper flange 7006 connectors 7111, 7112, 7113, and 7114. The power converter/relay assembly incorporates a LED indicator on top of the assembly that is visible through the sight glass 7113. The ultracapacitor modules 7400 are vertically interconnected mechanically and electrically through mechanical fasteners 7401 and electrical connectors 7402. The electrical connections 7402 allow for a series connection of modules to form a single capacitive device. The ultracapacitor module 7400 is formed of a plurality of ultracapacitor elements electrically connected in series to form a single capacitive unit. The individual ultracapacitors 7405 are mechanically arranged to fit in a cylindrical form, and mechanically linked to structural elements allowing for mechanical connection to fasteners 7401.

Figure 34:
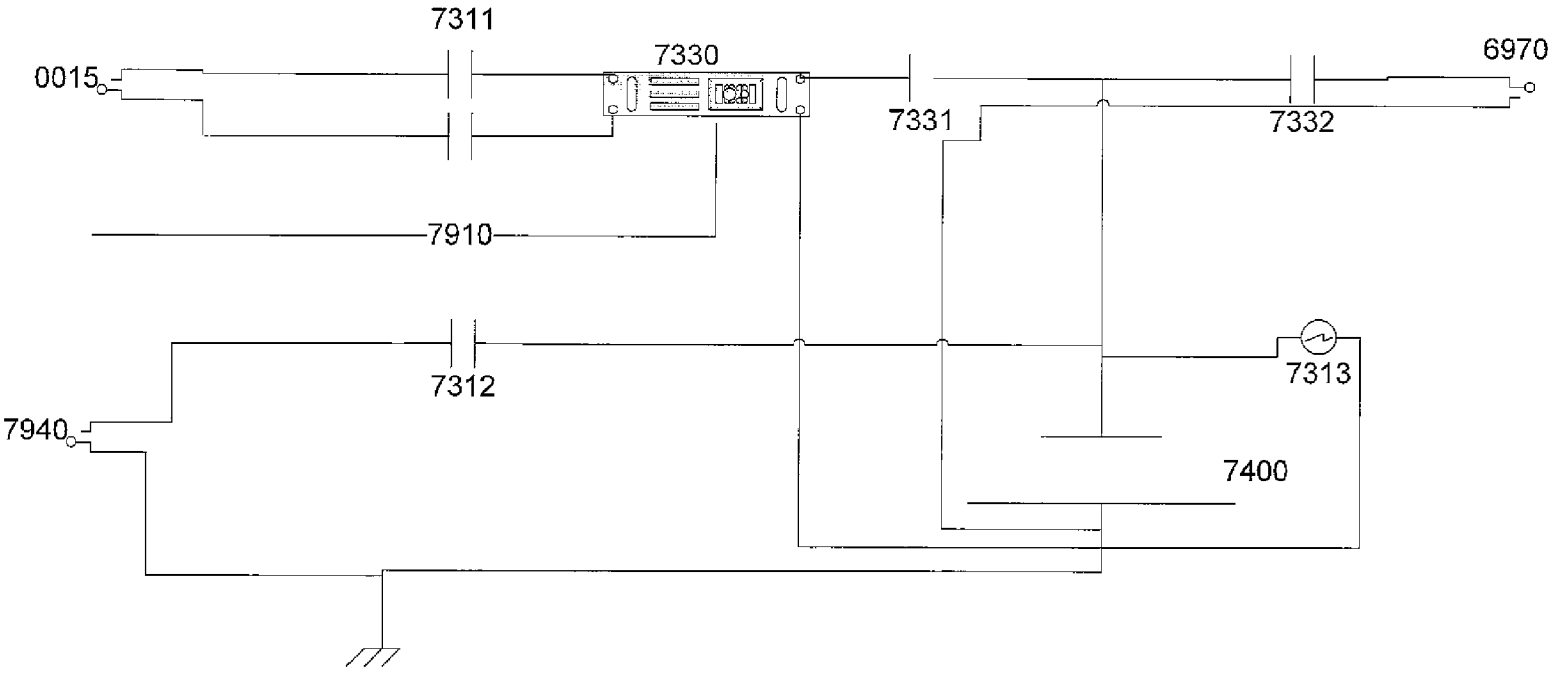
FIG. 34 is a schematic of a power pack.

FIG. 34 illustrates a schematic view of the power pack 7000. Incoming surface AC power 0015 can be isolated through relay 7311. Incoming DC power from the regenerator 8000 or other power packs 7000 can be isolated through relay 7312. The LED 7313 provides an indication of stored voltage present in the ultracapacitor array of 7400. The power controller module 7330 receives instrumentation power and communications on 7910, and is capable of operating in the absence of DC or AC power to the power pack. The module 7330 controls the incoming and outgoing relays.

The power packs can be used in multiple arrangements with parallel input power from 0015, and parallel output power to 6970 to extend operating times of the recharge pump 6000.

Figure 35:
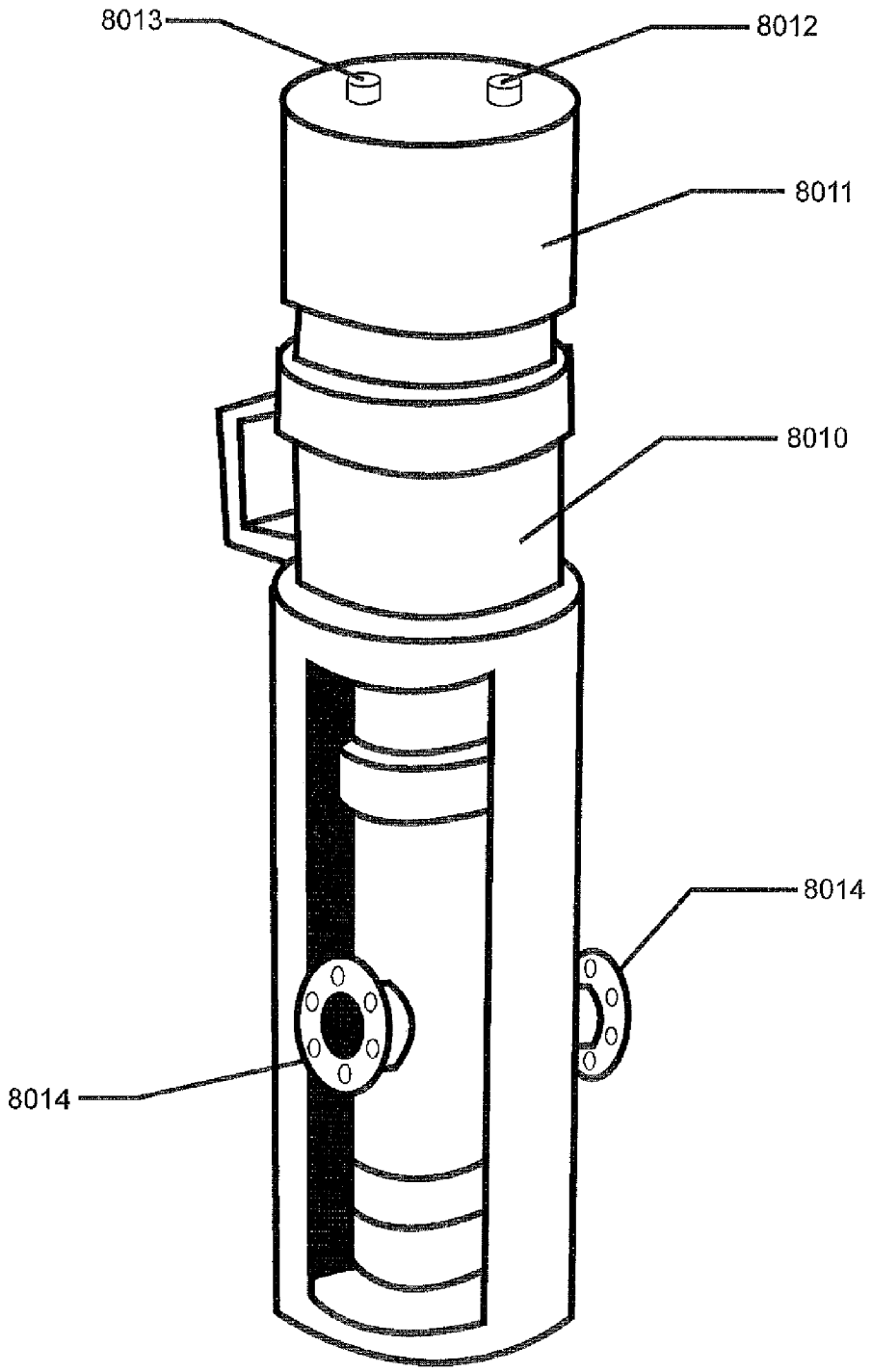
FIG. 35 is a regenerator assembly.

FIG. 35 illustrates an assembly view of the regenerator. The regenerator 8000 utilizes the flow of seawater through impeller inlet and outlets 8014 to the screen, in order to parasitically drive a flywheel alternator 8010 for generation of electrical power in use of recharging the power pack 7000. The flow rate through the regenerator 8000 is approximately 600 gpm for a period of 2 minutes, generating significant power from a small pressure drop across the regenerator 8000. Electrical power is made available through connection 8012, and the regenerator 8000 is connected to the external underwater control system via connector 8013.

Figure 36:
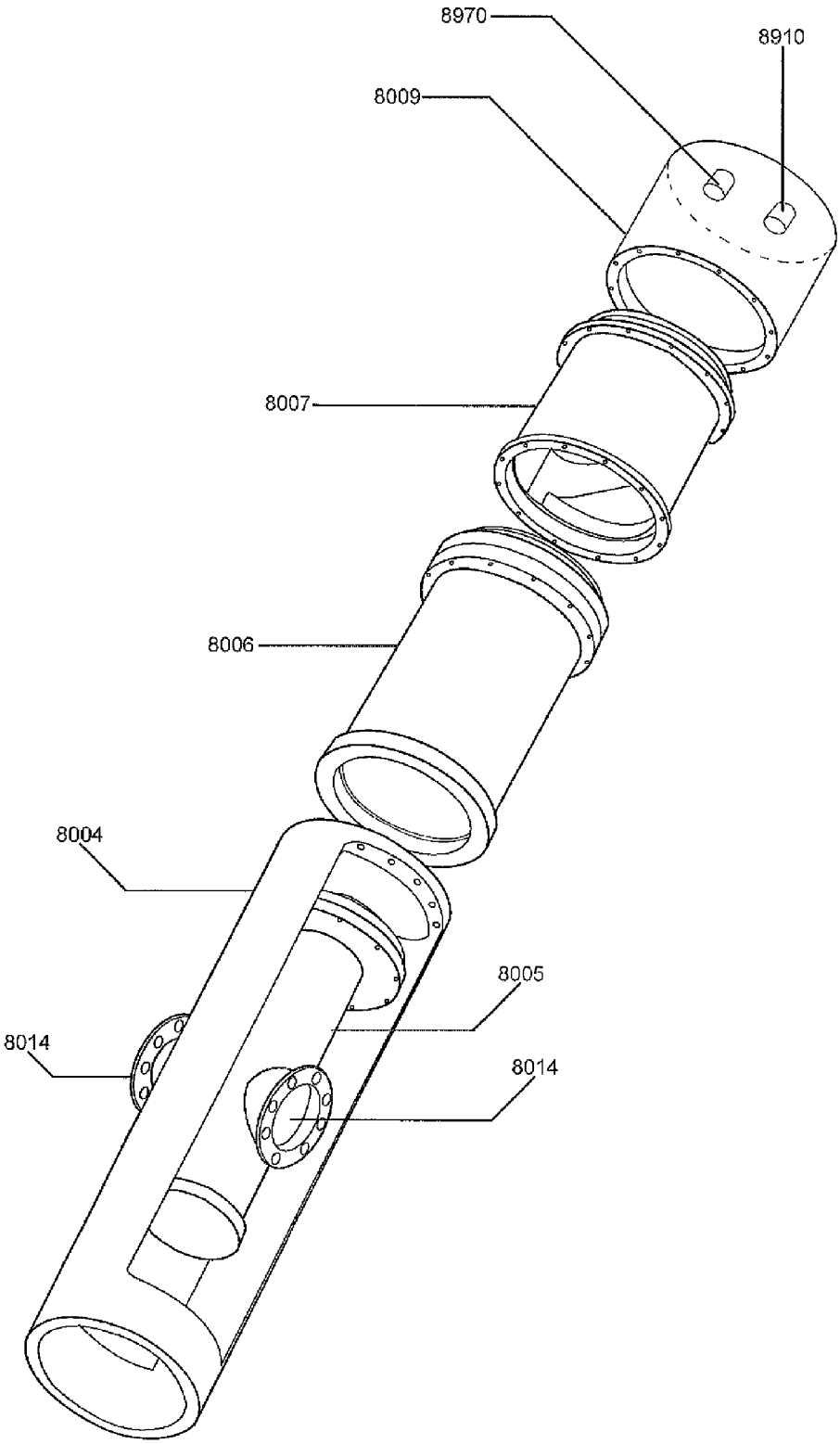
FIG. 36 is an exploded view of a regenerator assembly.

FIG. 36 illustrates an exploded view of the regenerator 8000. The regenerator 8000 is comprised of an Impeller housing 8005 with inlet and outlet ports 8014; an impeller transmission housing 8006; a flywheel/alternator housing 8007, and a power converter/controller housing 8009. The impeller housing 8005 contains an impeller and magnetic coupling to eliminate mechanical losses the pressure seals across the pressure bulkhead of the impeller transmission housing 8006. The impeller transmission housing 8006 contains a step-up transmission to multiply impeller speed, an overrunning clutch, and a flywheel/alternator to generate three phase AC voltage. The power converter/controller housing 8009 contains a rectifying buck boost DC power supply to provide DC voltage output 6970 to the power pack 7000. The power converter/controller provides for remote monitoring and control via 8910 to an external underwater control system.

Figure 37:
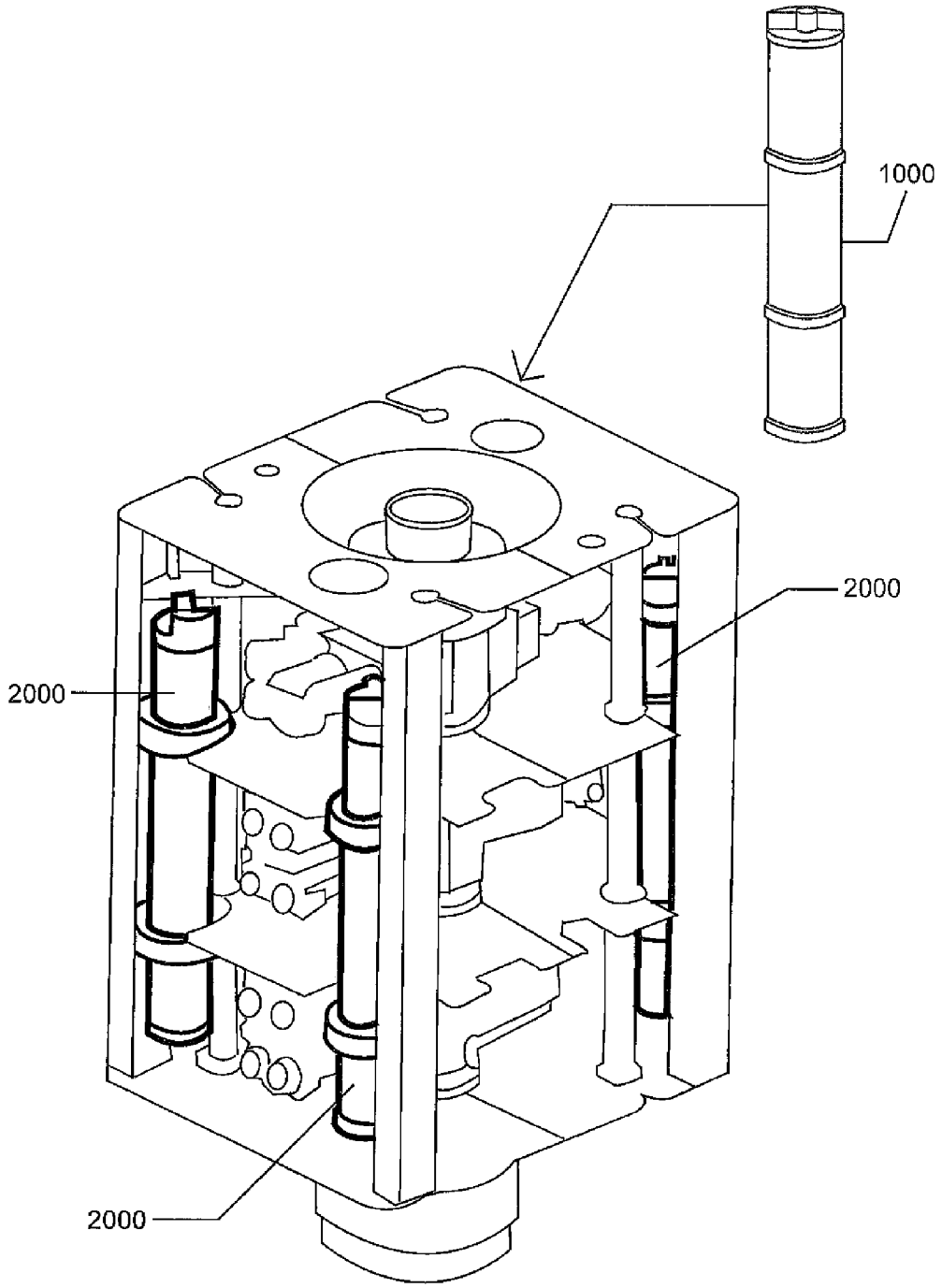
FIG. 37 is an embodiment of an accumulator in a subsea blowout preventer stack.

FIG. 37 illustrates the apparatus configured for use with only accumulators 2000 (refer to FIG. 6) in water depths less than 6000 feet as used in a subsea blowout preventer stack. The benefit of this configuration is the ability to utilize a BOP stack frame design to accommodate the four accumulators for shallow waters, and extend the operating depth by replacement of the accumulators 2000 with intensifiers 1000. The ease of replacement is supported by the use of a common outer barrel 1010 with common mounting accessories.

Figure 38:
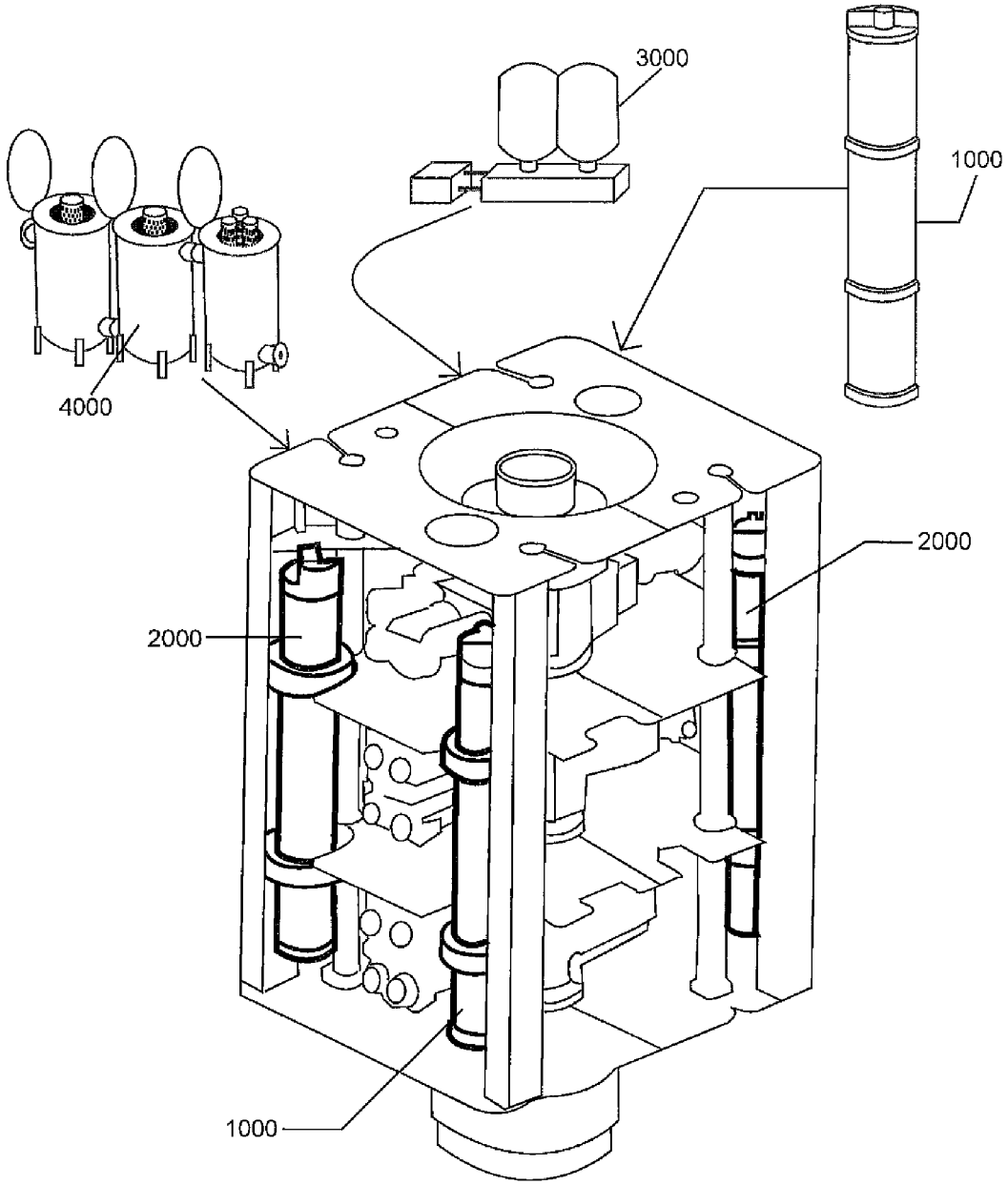
FIG. 38 is a hybrid embodiment in a subsea blowout preventer stack.

FIG. 38 illustrates the apparatus configured for use with accumulators 2000 and intensifiers 1000 (refer to FIG. 7) in water depths less than 9000 feet as used in a subsea blowout prevent stack. This embodiment extends the accumulator 2000 on configuration of FIG. 37, through the addition of the screen 4000, regulator 5000, reference 3000, and replacement of two accumulators 2000 with two intensifiers 1000.

Figure 39:
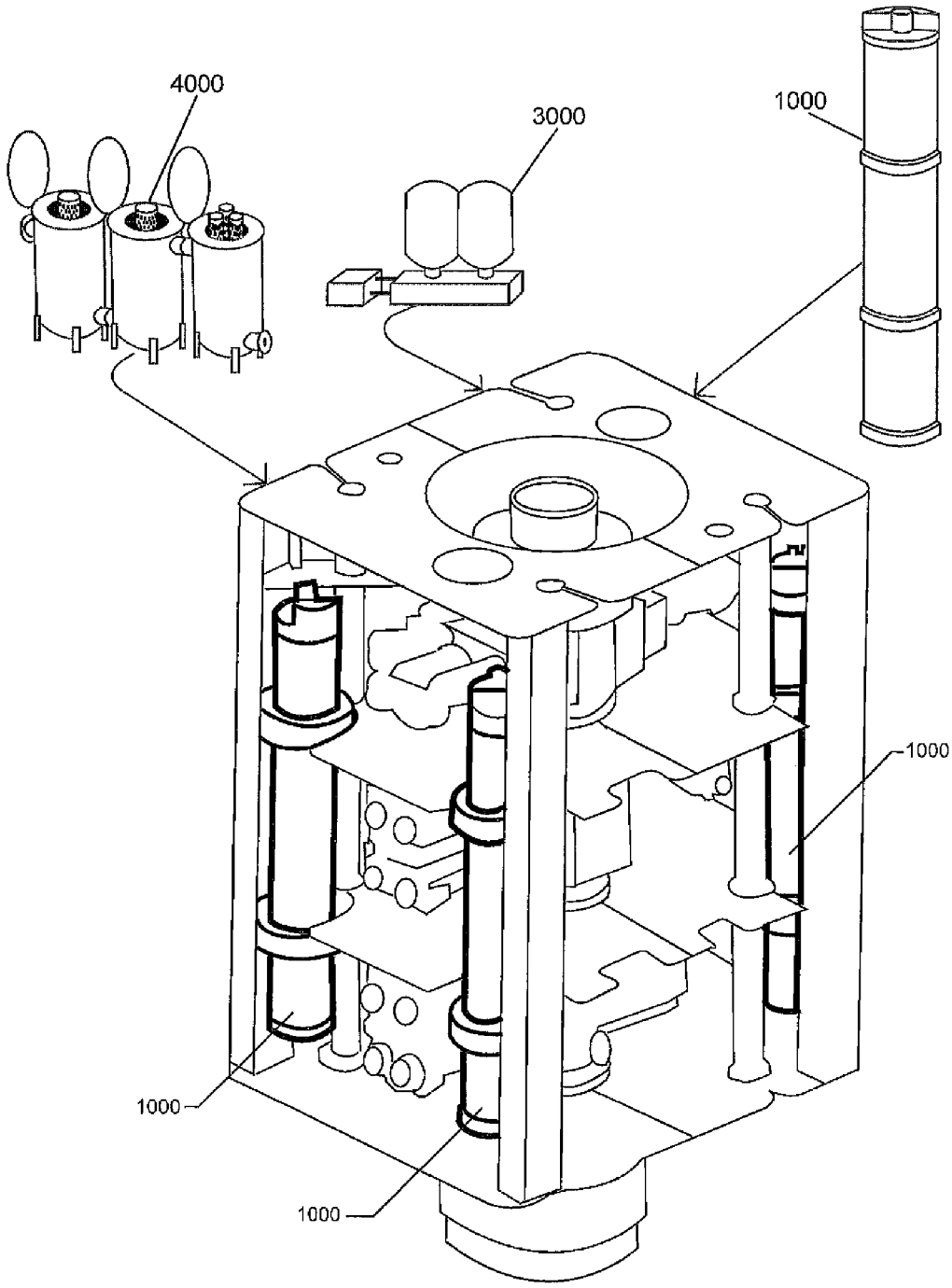
FIG. 39 is an embodiment of intensifier with no recharge pump in a subsea blowout preventer stack.

FIG. 39 illustrates the apparatus configured for use with intensifiers 1000 (refer to FIG. 8) in water depths less than 9000 feet as used in a subsea blowout prevent stack. This embodiment extends the hybrid configuration of FIG. 37, through the replacement of the two remaining accumulators 2000 for two intensifiers 1000.

Figure 40:
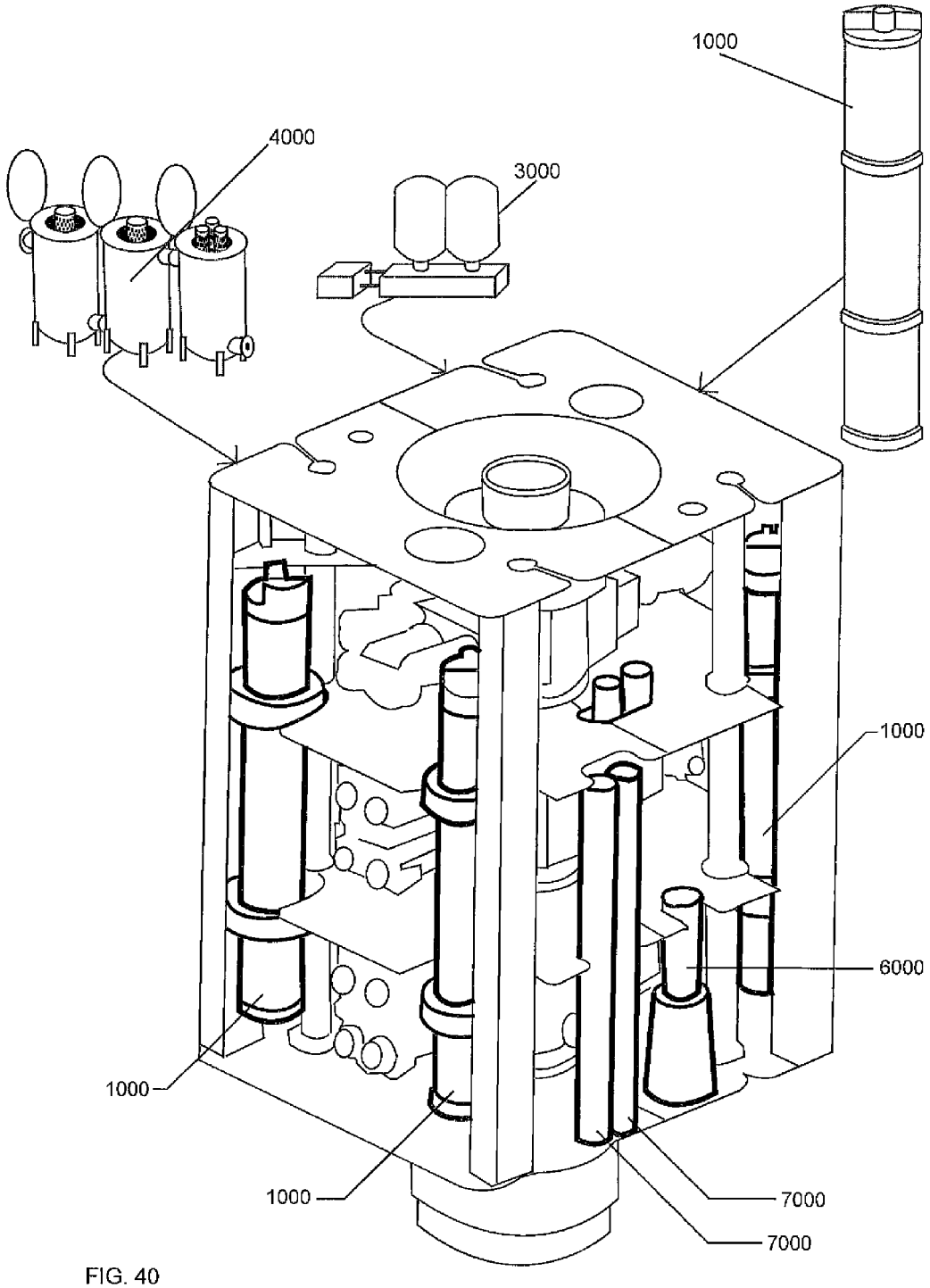
FIG. 40 is an embodiment of an intensifier with a recharge pump in a subsea blowout preventer stack.

FIG. 40 illustrates the apparatus configured for use with intensifiers 1000 (refer to FIG. 9) in water depths greater than 9000 feet as used in a subsea blowout prevent stack. This embodiment utilizes the configuration shown in FIG. 39, and adds the recharge pump 6000 and power pack 7000 to further extend the operating depth of the stack.

Figure 41:
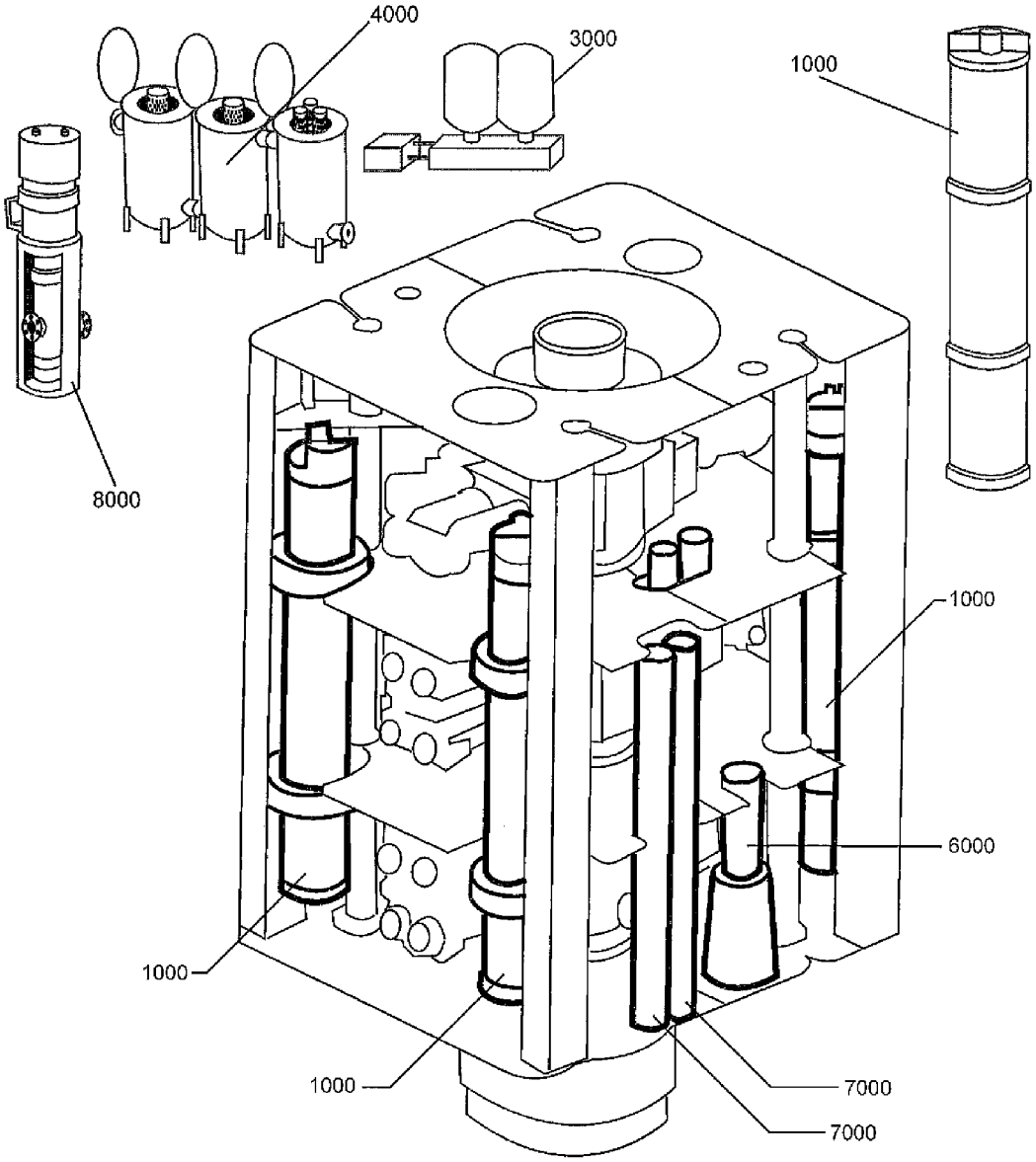
FIG. 41 is an embodiment of an intensifier with regeneration in a subsea blowout preventer stack.

FIG. 41 illustrates the apparatus configured for use with intensifiers 1000 (refer to FIG. 10) in water depths greater than 9000 feet as used in a subsea blowout prevent stack. Recharge times are decreased in this embodiment through the addition of the regenerator 8000 to the BOP stack.

Figure 42:
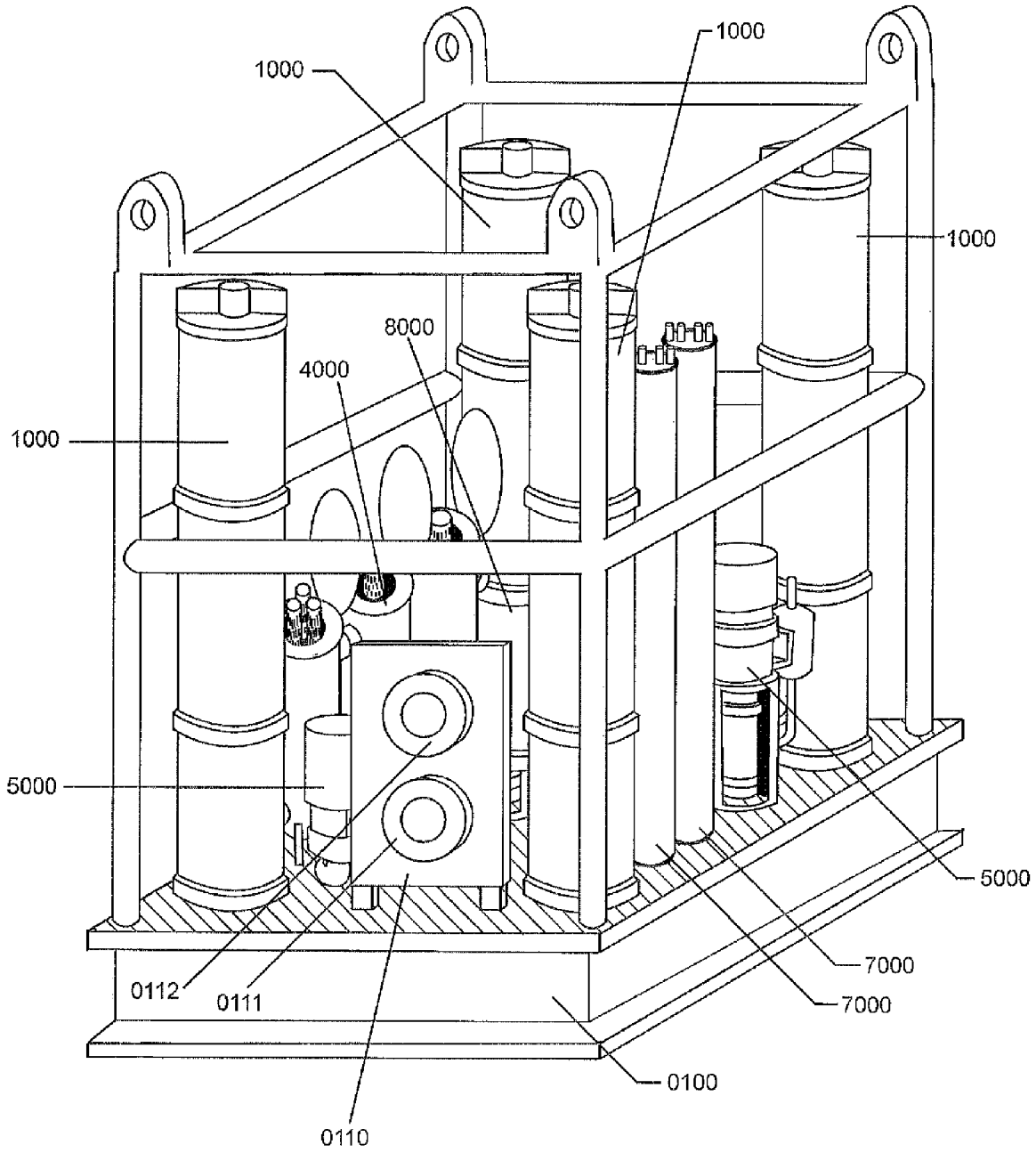
FIG. 42 is an embodiment of an intensifier with regeneration on a subsea mudmat.

FIG. 42 illustrates the apparatus configured for use with intensifiers 1000 (refer to FIG. 10) in water depths greater than 6000 feet as used to support subsea BOP stack, subsea production tree, subsea distribution unit, subsea production manifold, and other subsea electro-hydraulic consumers of hydraulic and electric power. This configuration utilizes a mudmat foundation 0100 with protective framework. External access to the configuration is via Remote Operated Vehicle (ROV) utilizing the panel 0110, and hydraulic flying lead stabplate 0111 and electric flying lead stabplate 0112 to connect between the apparatus and the external subsea equipment.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A subsea system including:

a frame of a subsea assembly including an intensifier, the intensifier configured to provide additional structural support to the frame and pressurized delivery fluid;

the intensifier including an intensifier chamber and a delivery fluid chamber separated by a piston, the intensifier chamber configured to receive ambient pressure to provide a pressure on the delivery fluid through the piston; and a regulation system configured to regulate the amount of ambient pressure communicated to the intensifier chamber to maintain the delivery fluid pressure substantially constant as the delivery fluid is depleted.

2. The system of claim 1, wherein the intensifier is rechargeable by resetting the piston using at least one of hydrostatic pressure, a recharge pump powered by a power pack, and an external fluid recovery tank.

3. The system of claim 2, wherein the power pack is configured to store power from a regenerator powered using fluid discharged from the intensifier.

4. The system of claim 1, further including an external delivery fluid recovery system.

5. The system of claim 1, wherein the regulation system includes a regulator, a reference pilot accumulator, and a reference reservoir, the regulation system being controllable using a closed-loop control system based in part on the delivery fluid pressure of the intensifier.

6. The system of claim 5, further including a reference pump to adjust the pressure of the reference pilot accumulator to change the delivery fluid pressure of the intensifier.

7. The system of claim 1, wherein the intensifier piston is operable as a pressure intensifying pump, wherein seawater pressure regulated by the regulation system is multiplied to the delivery fluid pressure by an intensification factor.

8. The system of claim 1, wherein the frame is configured to support a blowout preventer (BOP), the blowout preventer being operable using the delivery fluid.

9. The system of claim 1, further including a screen configured to filter seawater used by the intensifier and the regulation system.

10. The system of claim 1, wherein the frame is a mudmat, the system being configured to use the delivery fluid to operate at least one of a BOP stack, a subsea production tree, a subsea distribution unit, and a subsea production manifold.

11. The system of claim 1, the system being remotely controllable from the sea surface.

12. A subsea well system including:

a wellhead;

a blow-out preventer (BOP) frame configured to support at least one BOP and be connectable with the wellhead;

the BOP frame including an intensifier, the intensifier configured to provide structural support to the frame and pressurized delivery fluid;

the intensifier including an intensifier chamber and a delivery fluid chamber separated by a piston, the intensifier chamber being configured to receive ambient pressure to provide a pressure on the delivery fluid through the piston; and a regulation system configured to regulate the amount of ambient pressure communicated to the intensifier chamber to maintain the delivery fluid pressure substantially constant as the delivery fluid is depleted.

13. The subsea well system of claim 12, wherein the intensifier is rechargeable by resetting the piston using at least one of hydrostatic pressure, a recharge pump powered by a power pack, and an external fluid recovery tank.

14. The subsea well system of claim 13, wherein the power pack is configured to store power from a regenerator powered using fluid discharged from the intensifier.

15. The subsea well system of claim 12, further including an external delivery fluid recovery system.

16. The subsea well system of claim 12, wherein the regulation system includes a regulator, a reference pilot accumulator, and a reference reservoir, the regulation system being controllable using a closed-loop control system based in part on the delivery fluid pressure of the intensifier.

17. The subsea well system of claim 16, further including a reference pump to adjust the pressure of the reference pilot accumulator to change the delivery fluid pressure of the intensifier.

18. The subsea well system of claim 12, wherein the intensifier piston is operable an a pressure intensifying pump, wherein seawater pressure regulated by the regulation system is multiplied to the delivery fluid pressure by an intensification factor.

19. The subsea well system of claim 12, wherein the BOP is operable using the delivery fluid.

20. The subsea well system of claim 12, further including a screen configured to filter seawater used by the intensifier and the regulation system.

21. The subsea well system of claim 12, wherein the frame is a mudmat, the system being configured to use the delivery fluid to operate at least one of a BOP stack, a subsea production tree, a subsea distribution unit, and a subsea production manifold.

22. The subsea well system of claim 12, the system being remotely controllable from the sea surface.

* * * * *